US008336133B2

(12) United States Patent
Palay et al.

(10) Patent No.: US 8,336,133 B2
(45) Date of Patent: Dec. 25, 2012

(54) MULTI-FUNCTIONAL PATIENT TRANSFER DEVICE

(75) Inventors: Frederic Palay, Sugarloaf Key, FL (US); William E. Burak, Jr., Austin, TX (US)

(73) Assignee: Technimotion, LLC, San Antonio, TX (US)

( * ) Notice: Subject to any disclaimer, the term of this patent is extended or adjusted under 35 U.S.C. 154(b) by 685 days.

(21) Appl. No.: 12/418,404

(22) Filed: Apr. 3, 2009

(65) Prior Publication Data

US 2009/0249544 A1 Oct. 8, 2009

Related U.S. Application Data

(60) Provisional application No. 61/042,587, filed on Apr. 4, 2008.

(51) Int. Cl.
*A61G 7/10* (2006.01)

(52) U.S. Cl. ..... 5/83.1; 5/81.1 R; 5/88.1; 5/89.1

(58) Field of Classification Search ..... 5/81.1 R, 5/83.1, 86.1, 87.1, 88.1, 89.1
See application file for complete search history.

(56) References Cited

U.S. PATENT DOCUMENTS

| | | | |
|---|---|---|---|
| 662,477 | A | 11/1900 | Ulrich |
| 935,170 | A | 9/1909 | Smith |
| 1,620,298 | A | 3/1927 | Smith |
| 1,876,832 | A | 9/1932 | Bancroft |
| 1,961,119 | A | 5/1934 | Ettinger |
| 2,362,721 | A | 11/1944 | Reynolds |
| 2,666,930 | A | 1/1954 | Lenahan |
| 2,673,987 | A | 4/1954 | Upshaw et al. |
| 2,739,783 | A | 3/1956 | Pentecost |
| 2,891,256 | A | 6/1959 | Scully |
| 2,962,730 | A | 12/1960 | Carnes et al. |
| 3,099,020 | A | 7/1963 | Garfield et al. |
| 3,131,404 | A | 5/1964 | Bowers et al. |
| 3,137,011 | A | 6/1964 | Fischer |
| 3,271,796 | A | 9/1966 | Dillman |
| 3,310,816 | A | 3/1967 | James et al. |
| 3,732,584 | A | 5/1973 | James |
| 3,811,140 | A | 5/1974 | Burpo |
| 3,829,916 | A | 8/1974 | James |
| 3,914,808 | A | 10/1975 | Woods |

(Continued)

FOREIGN PATENT DOCUMENTS

DE 203 16 438 U1 3/2004

(Continued)

*Primary Examiner* — Robert G Santos
(74) *Attorney, Agent, or Firm* — Fulbright & Jaworski, L.L.P.

(57) ABSTRACT

One embodiment of the present invention comprises a multi-functional patient transfer device for transferring mobility-impaired patients. In one embodiment, the multi-functional patient transfer device includes a lift cart and one or more lift components. The lift components may attach to the lift cart and/or other lift components. The lift components may include frontal bars, a tabletop, a central arm, lifting forks, a hoist, a knee blocker, footrests, a transfer chair, detachable handles, and/or safety cushions. Embodiments of the present invention may include one or more patient interfaces. The patient interfaces may attach to the lift cart and/or one or more lifting components. The patient interfaces may include slings, chairs, straps, harnesses, and/or transfer sheets. In one embodiment, the patient interfaces may include foldable panels. In one embodiment, the patient interfaces may include a buttock/link support. Example embodiments of methods of the present invention may include frontal transfers, lateral seated transfers, lateral bed transfers, and sit-to-stand transitions.

61 Claims, 26 Drawing Sheets

U.S. PATENT DOCUMENTS

| | | | | |
|---|---|---|---|---|
| 3,940,808 | A | | 3/1976 | Petrini |
| 3,981,484 | A | | 9/1976 | James |
| 4,010,499 | A | | 3/1977 | Davis et al. |
| 4,138,750 | A | | 2/1979 | Michalowski |
| 4,144,713 | A | | 3/1979 | Clark et al. |
| 4,232,412 | A | | 11/1980 | Petrini |
| 4,393,529 | A | | 7/1983 | Britz |
| 4,432,359 | A | | 2/1984 | James |
| 4,554,691 | A | | 11/1985 | Daugherty |
| 4,569,094 | A | | 2/1986 | Hart et al. |
| 4,571,758 | A | | 2/1986 | Samuelsson |
| 4,579,381 | A | | 4/1986 | Williams |
| 4,631,761 | A | | 12/1986 | Lederman |
| 4,633,538 | A | | 1/1987 | James |
| 4,669,943 | A | | 6/1987 | Zamotin |
| 4,703,523 | A | | 11/1987 | James |
| 4,737,997 | A | | 4/1988 | Lamson |
| 4,761,842 | A | | 8/1988 | Weiner |
| 4,783,862 | A | | 11/1988 | Murphy |
| 4,794,655 | A | | 1/1989 | Ooka et al. |
| 4,858,261 | A | | 8/1989 | Iura |
| 4,862,997 | A | | 9/1989 | Eberle |
| 4,920,590 | A | | 5/1990 | Weiner |
| 4,970,738 | A | | 11/1990 | Cole |
| 4,987,620 | A | | 1/1991 | Sharon |
| 4,997,200 | A | | 3/1991 | Earls |
| 5,022,810 | A | | 6/1991 | Sherrow et al. |
| 5,023,968 | A | | 6/1991 | Diehl et al. |
| 5,038,425 | A | | 8/1991 | Merry |
| 5,112,076 | A | | 5/1992 | Wilson |
| 5,163,189 | A | | 11/1992 | DeGray |
| 5,193,633 | A | | 3/1993 | Ezenwa |
| 5,255,934 | A | | 10/1993 | Wilson |
| 5,257,425 | A | | 11/1993 | Shinabarger |
| 5,263,213 | A | | 11/1993 | Robertson et al. |
| 5,333,887 | A | | 8/1994 | Luther |
| 5,355,538 | A | | 10/1994 | Fulford et al. |
| 5,369,821 | A | | 12/1994 | Richards et al. |
| 5,375,277 | A | | 12/1994 | Carr et al. |
| 5,379,468 | A | | 1/1995 | Cassidy et al. |
| 5,388,289 | A | | 2/1995 | Casperson |
| 5,460,394 | A | | 10/1995 | Novi |
| 5,572,756 | A | | 11/1996 | Muuranen et al. |
| 5,626,398 | A | | 5/1997 | Wooldridge |
| 5,644,805 | A | | 7/1997 | Horcher |
| 5,697,110 | A | | 12/1997 | Campbell |
| 5,704,081 | A | | 1/1998 | Bollinger |
| 5,708,993 | A | | 1/1998 | Campbell et al. |
| 5,754,992 | A | | 5/1998 | Melnick et al. |
| 5,809,591 | A | | 9/1998 | Capaldi et al. |
| 5,878,450 | A | | 3/1999 | Bouhuijs |
| 5,892,180 | A | | 4/1999 | Carey |
| 5,896,602 | A | | 4/1999 | Marblestone |
| 5,934,282 | A | | 8/1999 | Young, III et al. |
| 5,937,456 | A | | 8/1999 | Norris |
| 5,966,754 | A | | 10/1999 | Schuster |
| 5,987,664 | A | | 11/1999 | Somerton et al. |
| 5,996,150 | A | | 12/1999 | Blevins et al. |
| 6,085,368 | A | * | 7/2000 | Robert et al. ..... 5/85.1 |
| 6,131,215 | A | | 10/2000 | Lindell |
| 6,134,725 | A | | 10/2000 | Bouhuijs |
| 6,154,899 | A | | 12/2000 | Brooke et al. |
| 6,175,973 | B1 | | 1/2001 | Hakamiun et al. |
| 6,201,195 | B1 | | 3/2001 | Carey |
| 6,260,218 | B1 | | 7/2001 | Tsuga |
| 6,329,612 | B1 | | 12/2001 | von Schroeter |
| 6,336,235 | B1 | | 1/2002 | Ruehl |
| 6,367,103 | B1 | | 4/2002 | Collins |
| 6,381,781 | B1 | | 5/2002 | Bourgraf et al. |
| 6,427,270 | B1 | | 8/2002 | Blevins et al. |
| 6,430,761 | B1 | | 8/2002 | Brandorff et al. |
| 6,449,785 | B1 | | 9/2002 | Liljedahl |
| 6,477,728 | B1 | | 11/2002 | Faz |
| 6,557,189 | B2 | | 5/2003 | von Schroeter |
| 6,568,002 | B1 | | 5/2003 | Liljedahl |
| 6,581,222 | B1 | | 6/2003 | Liljedahl |
| 6,651,280 | B2 | | 11/2003 | Blevins |
| 6,691,349 | B2 | | 2/2004 | Blevins |
| 6,799,770 | B2 | | 10/2004 | Patrick et al. |
| 6,834,402 | B2 | | 12/2004 | Hanson et al. |
| 6,854,137 | B2 | | 2/2005 | Johnson |
| 6,978,497 | B1 | | 12/2005 | Takizawa |
| 7,000,268 | B2 | | 2/2006 | Johnson |
| 7,356,858 | B2 | | 4/2008 | Summers |
| 7,360,262 | B2 | | 4/2008 | Mowery |
| 2001/0027574 | A1 | | 10/2001 | Bouhuys |
| 2003/0213064 | A1 | | 11/2003 | Johnson |
| 2004/0049855 | A1 | | 3/2004 | Leoutsakos |
| 2004/0154097 | A1 | | 8/2004 | Blevins |
| 2005/0135907 | A1 | | 6/2005 | Romano et al. |
| 2006/0213007 | A1 | | 9/2006 | Palay et al. |
| 2007/0028381 | A1 | | 2/2007 | Palay et al. |
| 2009/0249544 | A1 | * | 10/2009 | Palay et al. ..... 5/83.1 |
| 2010/0154115 | A1 | | 6/2010 | Wernqvist et al. |

FOREIGN PATENT DOCUMENTS

| | | | |
|---|---|---|---|
| EP | 452072 | A2 | 10/1991 |
| EP | 518692 | A1 | 12/1992 |
| EP | 1 142 550 | | 10/2001 |
| GB | 2 213 735 | | 8/1989 |
| GB | 2242885 | A | 10/1991 |
| GB | 2 277 020 | | 10/1994 |
| WO | WO-91/12975 | A1 | 9/1991 |
| WO | WO-98/34575 | A2 | 8/1998 |
| WO | WO 03/090658 | A | 11/2003 |
| WO | WO-2004/039300 | A1 | 5/2004 |
| WO | PCT/US2006/009066 | | 9/2007 |
| WO | PCT/US2008/086672 | | 2/2009 |

* cited by examiner

MULTI-FUNCTIONAL PATIENT TRANSFER DEVICE

CROSS-REFERENCE TO RELATED APPLICATIONS

This non-provisional application claims priority based upon prior U.S. Provisional Patent Application Ser. No. 61/042,587 filed Apr. 4, 2008 in the name of Frederic Palay and William E. Burak, Jr., entitled "Multi-Functional Patient Transfer Device," the entirety of which is incorporated herein by reference.

BACKGROUND OF THE INVENTION

The present invention relates generally to patient handling systems and, more particularly, to patient handling systems with a multi-functional patient transfer device.

The field of patient handling is gaining increased attention as a result of nursing shortages, caregiver injuries, and the rising incidence of obesity in western societies. At the same time, existing approaches to patient handling have several limitations. Manual patient handling systems, for example, generally rely on various lifting and sliding techniques to move a patient. Such systems can lead to discomfort and injury to both patient and caregiver and, in many cases, require the presence of more than one caregiver. Traditional mechanical solutions, such as floor-based hoists, ceiling lifts, and lateral transfer systems, have been shown to decrease the incidence of caregiver musculoskeletal injury but still present significant safety risks to patients. In addition, traditional mechanical solutions are generally large, heavy, and difficult to transport. Traditional mechanical solutions also typically perform only a single transfer function.

Therefore, it can be appreciated that there is a significant need for a multi-functional patient transfer device that can be compact, lightweight, and easily transportable. It can further be appreciated that there is a significant need for a multi-functional patient transfer device that is capable of performing more than one patient transfer function. Embodiments of the present invention can provide these and other advantages, as will be apparent from the following detailed description and accompanying figures.

BRIEF SUMMARY OF THE INVENTION

One embodiment of the present invention comprises a multi-functional patient transfer device for transferring mobility-impaired patients. In one embodiment, the multi-functional patient transfer device includes a lift cart and one or more lift components. The lift components may attach to the lift cart and/or other lift components. The lift components may include frontal bars, a tabletop, a central arm, lifting forks, a hoist, a knee blocker, footrests, a transfer chair, handles, and/or safety cushions. In one embodiment, the multi-functional patient transfer device may include one or more patient interfaces. The patient interfaces may attach to the lift cart and/or one or more lifting components. The patient interfaces may include slings, chairs, straps, harnesses and/or transfer sheets. Example methods that may be performed with embodiments of the multi-functional patient transfer device include frontal seated transfers, lateral seated transfers, lateral bed transfers, and standing aid transfers.

In one embodiment, the multi-functional patient transfer device may include a lift cart containing a central structure and a central arm connectable to the central structure and including a patient interface connectable to the central arm. In this embodiment, the shape of the central arm includes a curve that approximates the curvature of the chest of a patient. In addition, the central structure is capable of raising and lowering a patient with (i) the patient interface supporting the patient, (ii) the patient interface connected to the central arm, and (iii) the central arm extending horizontally across the front of the patient and positioned approximately between the head and knees of the patient.

In another embodiment, the multi-functional patient transfer device may include a lift cart containing a central structure, frontal bars connectable to the central structure and having two arms that are approximately parallel, and a cable connectable to the frontal bars and to the lift cart. In this embodiment, the central structure is capable of raising and lowering the frontal bars. In addition, in this embodiment, the frontal bars may rotate between angles in which the arms extend outward from the lift cart with an approximately horizontal orientation and in which the arms extend upwards from the lift cart with an approximately vertical orientation. Also, in this embodiment, the cable may assist the rotation of the frontal bars when the central structure raises the frontal bars.

In yet another embodiment, the multi-functional patient transfer device may include a lift cart containing a central structure, a central arm connectable to the central structure and including a patient interface connectable to the central arm, and frontal bars having two arms that are approximately parallel. In this embodiment, the central structure is connectable to the frontal bars and capable of raising and lowering the frontal bars. Also, in this embodiment, central structure is capable of raising and lowering a patient with (i) the patient interface supporting the patient, (ii) the patient interface connected to the central arm, and (iii) the central arm extending horizontally across the front of the patient and positioned approximately between the head and knees of the patient.

DETAILED DESCRIPTION

One preferred embodiment of the present invention comprises a multi-functional patient transfer device for transferring mobility-impaired patients. In one embodiment, the multi-functional patient transfer device includes a lift cart and one or more lift components. The lift components may attach to the lift cart and/or other lift components. As described in more detail below, the lift components may include frontal bars, a tabletop, a central arm, lifting forks, a hoist, a knee blocker, footrests, a transfer chair, detachable handles, and/or safety cushions. Embodiments of the present invention may also include one or more patient interfaces. The patient interfaces may attach to the lift cart and/or lifting components. As described in more detail below, the patient interfaces may include slings, chairs, straps, harnesses and/or transfer sheets. Example embodiments of methods of the present invention may include frontal transfers, lateral seated transfers, lateral bed transfers, and sit-to-stand transitions. Embodiments of the present invention may be used in a hospital, long-term care facility, skilled nursing facility, rehabilitation facility, a patient's home or other locations and can be used alone or in conjunction with other patient lifting devices such as a ceiling lift, a floor-based hoist, low-friction sliding transfer sheets or a sliding roller board.

Figure 1:
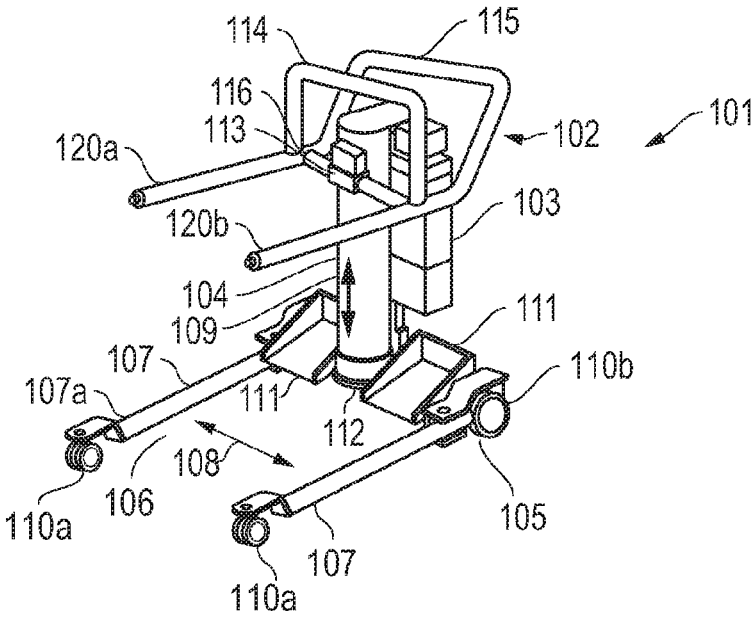
FIG. 1 shows a perspective view of one embodiment of the device of the present invention with frontal bars rotated horizontally.

Reference is now made to FIG. 1 which shows a perspective view of one embodiment of the device of the present invention with frontal bars 102 rotated horizontally. In this embodiment, the multi-functional patient transfer device 101 is shown to include frontal bars 102 and a lift cart 103. The lift cart 103 may contain wheels 110 which allow it to roll across floors or ground surfaces. The wheels 110 may be in the form of casters. The lift cart 103 may also contain brakes (not shown) for restricting movement of the lift cart 103. In one embodiment, the distal wheels 110*a* are of a smaller size than the proximal wheels 110*b*. The lift cart 103 is shown to contain a central structure 104 with a vertical orientation that connects to the frontal bars 102 and a base 105. In one embodiment, the base 105 is shown to include a u-shaped frame 106 with two legs 107 that may provide stability to the central structure 104. In one embodiment, the length of the legs 107 of the u-shaped frame 106 may extend in order to provide additional stability to the lift cart 103. For example, the legs 107 may include telescoping extensions. The distance 108 between the legs 107 may also be increased. In one embodiment, for example, the legs 107 may pivot at their point of attachment to the base 105 so that the distal portion of the legs 107*a* spread apart from one another. In addition, the base 105 is shown to include footrests 111 in this embodiment. In one embodiment, a knee blocker (not shown) may be attached to the central structure 104.

In this embodiment, the central structure 104 is attached in a vertical orientation from the base 105. The shape of the central structure 104 in this embodiment is shown to include a cylinder 109, but other embodiments may include other shapes without departing from the spirit and scope of the invention. The central structure 104 may contain a sliding sleeve 112 and may extend and retract in a vertical direction in order to raise and lower the central structure 104. In alternative embodiments, the central structure 104 of the lift cart 103 may be raised or lowered using powered lifting mechanisms such as a hydraulic pump, actuator, motor, threaded screw mechanism or mechanical jack. The movement of the central structure 104 may also raise and lower the height of the frontal bars 102, as well as other lift components that may be connected to the central structure 104 from time to time, patient interfaces that may be connected to such lift components, and patients supported by such lift components and/or patient interfaces.

Figure 2:
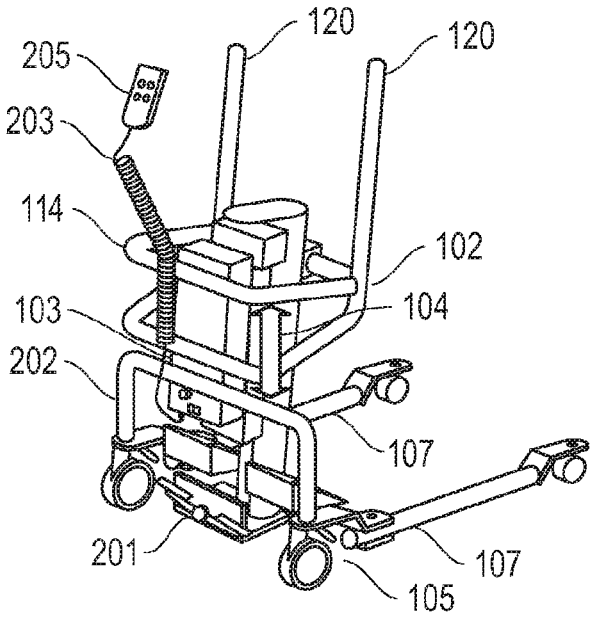
FIG. 2 shows a perspective view of one embodiment of the device of the present invention with frontal bars rotated vertically.

Still referring to FIG. 1, the frontal bars 102 are shown attached to an attachment plate 113 that, in this embodiment, is secured to the central structure 104. The attachment plate 113 may securely hinge to the attachment bar 116 of the frontal bars 102 to the central structure 104 and allow the frontal bars 102 to rotate without exposing a patient to pinch points. The degree of allowable rotation may be varied. In one embodiment, the frontal bars 102 may rotate between angles in which the arms 120 of the frontal bars 102 extend outward from the lift cart 103 in a horizontal orientation, such as shown in FIG. 1, and angles in which the arms 120 of the frontal bars 102 extend upwards from the lift cart 103 with an approximately vertical orientation, such as shown in FIG. 2. In addition, the degree of rotation of the frontal bars 102 at any given time may be independent of the height of the frontal bars 102 or, as explained in more detail below, may be dependent on the height of the frontal bars 102.

Reference is now made to FIG. 2, which shows a perspective view of one embodiment of the device of the present invention with frontal bars 102 rotated vertically. In this embodiment, foot pedals 201 are shown located at the base 105 to allow a caregiver to spread the legs 107 of the lift cart 103 as described above. It can be appreciated that other embodiments may include other mechanisms for moving the legs 107, such as a hand activated lever, for example, without departing from the spirit and scope of the invention. Also, a control box 204, which may contain an electric actuator, for example, is shown attached to the central structure 104. A handheld control unit 205 is shown to connect to the control box 204 via a modular communication cord 203. A safety bar 202 is also shown which can serve to restrict the caregiver movements toward the central structure 104 and add structural support to the lift cart 103.

Referring again to FIG. 1, the frontal bars 102 are shown in this embodiment to contain a left arm 120*a* and a right arm 120*b*. The left arm 120*a* and the right arm 120*b* may be gripped by a patient, for use as a standing aid, for example. A variety of patient interfaces may connect to the left arm 120*a* and the right arm 120*b*. For example, patient interfaces may connect to the left arm 120*a* and right arm 120*b* and assist the transition of a patient from a sitting position to a standing position or assist the transfer of a patient in a seated position. In one embodiment, the arms 120 provide multiple points of attachment for patient interfaces. Such multiple attachment points may, for example, allow a particular patient interface to attach in a manner that is best suited for a particular patient or may allow for the attachment of different types of patient interfaces.

The frontal bars 102 are also shown in this embodiment to have an inner handlebar 114 and an outer handlebar 115. When the frontal bars 102 are rotated so that the arms 120 extend horizontally, as shown in FIG. 1, a patient may grip the inner handlebar 114 for support while standing or as an aid to transition from a sitting to a standing position. In addition, a caregiver may grip the outer handlebar 115 to move the lift cart 103 to a desired location or to manually rotate the frontal bars 102. Similarly, when the frontal bars 102 are rotated so that the arms 120 extend vertically, as shown in FIG. 2, a caregiver may grip the inner handlebar 114 to move the lift cart to a desired location or manually rotate the frontal bars 102 so that the arms 120 extend horizontally, as shown in FIG. 1. In one embodiment, the frontal bars 102 may connect to the lift cart 103 in a detachable manner.

Figure 3A:
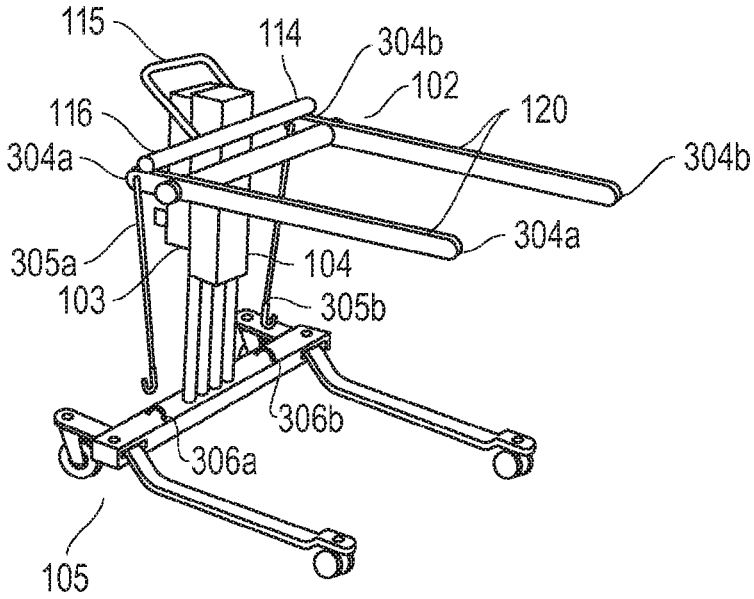
FIG. 3*a* shows a perspective view of one embodiment of the device of the present invention with cables to assist rotation of the frontal bars.

Reference is now made to FIG. 3*a*, which shows a perspective view of one embodiment of the device of the present invention with cables 305 to assist rotation of the frontal bars 102. In one embodiment, the frontal bars 102 may function as lever machine with the arms 120 of the frontal bars 102 functioning as load arms, the attachment bar 116 functioning as a fulcrum, and a portion of the frontal bars 102, other than the arms 120 and the attachment bar 116, functioning as a lever. The frontal bars 102 in this embodiment are shown to contain a left arm 304*a* with a lever end 304*a*' and a right arm 304*b* with a lever end 304*b*'. The frontal bars 102 are also shown to contain alternative embodiments of an inner handlebar 114 and an outer handlebar 115. In one embodiment, the lifting mechanism of the lift cart 103 may be used to assist the rotation of the frontal bars 102. For example, a cable 305*a* may connect to the lever end 304*a*' of the left arm 304*a* and a secure portion of the lift cart 103 that, for example, does not increase in height with upward movement of the central structure 104 or decrease in height with downward movement of the central structure 104. An example secure position may be a first connector 306*a* on the base 105. In an alternative embodiment, a second cable 305*b* may attach to the lever end 304*b*' of the right arm 304*b* and a secure portion of the lift cart 103, such as a second connector 306*b* on the base 105. In an alternative embodiment, the cable 305 may attach to the inner handlebar 114 or the outer handlebar 115 as the lever portion.

Figure 3B:
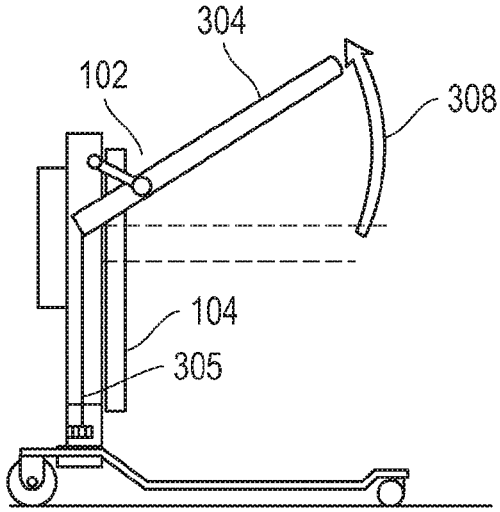
FIG. 3*b* shows a side view of one embodiment of the device of the present invention with a cable assisting the rotation of the frontal bars.

Reference is now made to FIG. 3*b*, which shows a side view of one embodiment of the device of the present invention with a cable 305 assisting the upward rotation of the frontal bars 102. With the attachment of one or both cables 305, raising the central structure 104 will rotate the arms 304 of the frontal bars 102 upwards 308 until the arms 304 extend vertically. Conversely, if the central structure 104 is lowered with the attachment of one or both cables 305, the arms 304 of the frontal bars 102 will rotate downwards until the arms 304 extend horizontally 307. In an alternative embodiment, the arms 304 frontal bars 102 may rotate past horizontal.

As described in more detail below, rotation of the frontal bars 102 may be used to assist a patient transitioning from a sitting to a standing position. In one embodiment, the length of the cable 305 may be adjusted in order to synchronize the rotation of the frontal bars 102 with the vertical movement of the central structure 104. For example, shortening the cable 305 may allow the frontal bars 102 to begin rotating at a lower point in the vertical movement of the central structure 104 than the point in the vertical movement of the central structure 104 at which the frontal bars 102 begin to rotate with a longer cable 305. It can be appreciated that other embodiment may include other types of mechanism to assist rotation of the frontal bars without departing from the scope and spirit of the present invention.

Figure 4:
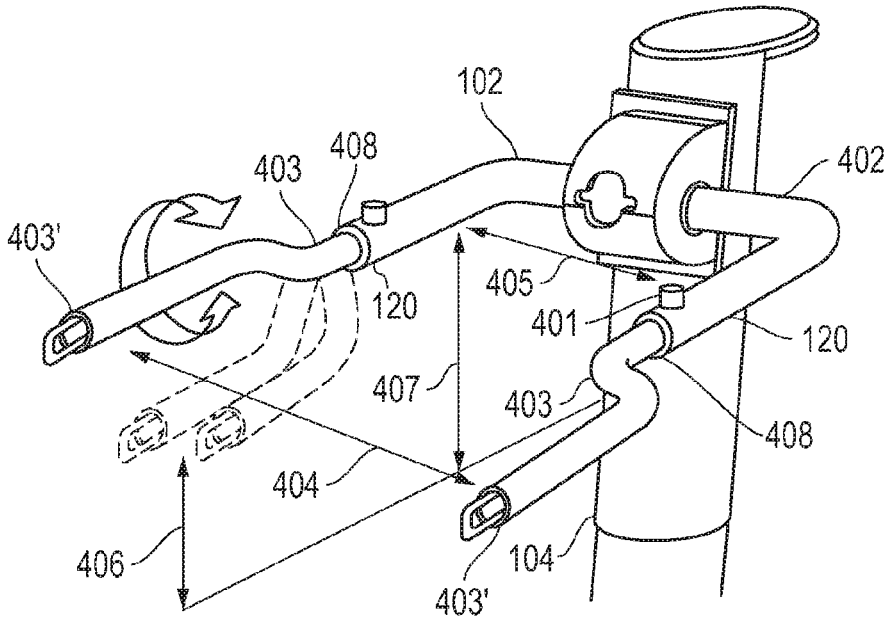
FIG. 4 shows a perspective view of one embodiment of adjustable frontal bars of one embodiment of the device of the present invention.

Reference is now made to FIG. 4, which shows a perspective view of one embodiment of adjustable frontal bars 102 of one embodiment of the device of the present invention. In this embodiment, the width and height of the arms 403 of the frontal bars 102 may be individually or mutually adjustable. The width and height of the arms 120 of the frontal bars 102 may also be adjusted without vertical movement of the central structure 104. For example, the frontal bars 102 are shown in FIG. 4 to contain a u-shaped section 402 and two elongated s-shaped arms 403. One elongated s-shaped arm 403 is shown extending from each end 408 of the u-shaped section 402.

Each elongated s-shaped arm 403 may be rotated about its longitudinal axis within the u-shaped section 402 in order to position the distal end 403' of the elongated s-shaped arm 403. The frontal bars 102 may also contain a locking mechanism 401 for restricting the rotation of the elongated s-shaped arms 403. For example, the distal end 403' of the elongated s-shaped arm 403 may be positioned so that the width 404 between the distal ends 403' of the two elongated s-shaped arms 403 is either wider or narrower than the width 405 between the two ends 408 of the u-shaped section 402. Alternatively, the distal ends 403' of the elongated s-shaped arms 403 may be positioned so that the height 406 of the distal ends 403' of the two elongated s-shaped arms 403, relative to a point on the central structure 104, for example, is either greater than or less than the height 407 of the two ends 408 of the u-shaped section 402. For example, the distal ends 403' of the elongated s-shaped arms 403 may be positioned so that the width 404 between the distal ends 403' of the two elongated s-shaped arms 403 is wider than the width 405 between the two ends 408 of the u-shaped section 402. This additional width 404 may be preferable for patients with broad shoulders or a wide girth. In addition, the distal ends 403' of the elongated s-shaped arms 403 may be positioned so that the height 406 of the distal ends 403' of the two elongated s-shaped arms 403 is less than the height 407 of the two ends 408 of the u-shaped section 402 in order to, for example, compensate for the relative height or arm length of a particular patient.

Figure 5:
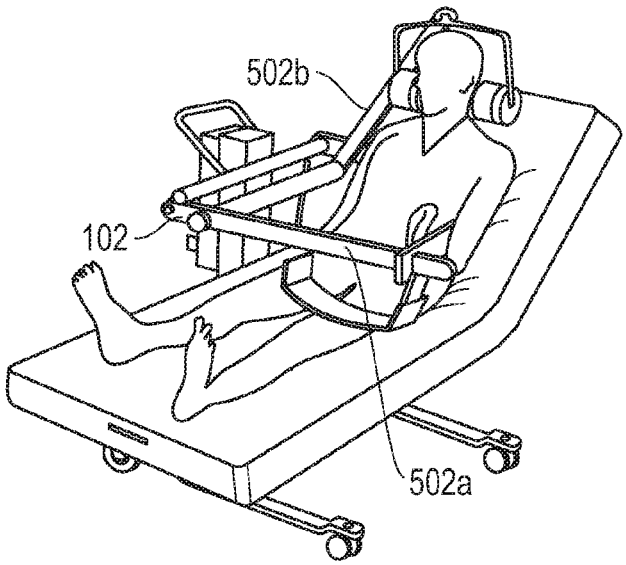
FIG. 5 shows a perspective view of one embodiment of the device of the present invention with frontal bars containing individually pivoting arms.

Reference is now made to FIG. 5, which shows a perspective view of one embodiment of the device of the present invention with frontal bars 102 containing individually pivoting arms 502. In this embodiment, the arms 502 of the frontal bars 102 may individually pivot, and may lock into place, at multiple angles between, and including, horizontal and vertical. In FIG. 5 for example, the left arm 502*a* of the frontal bars 102 is shown to extend horizontally. The right arm 502*b*, however, is shown to have been pivoted and locked at an angle between horizontal and vertical. As will be described in more detail below, a patient may be transferred laterally with one embodiment of the device of the present invention that includes individually pivoting arms 502.

Figure 6:
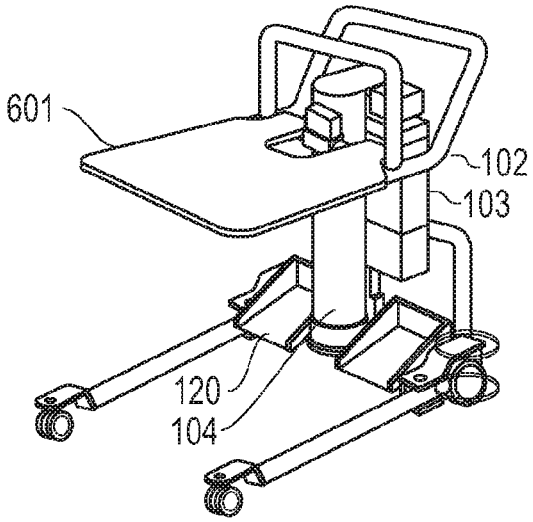
FIG. 6 shows a perspective view of one embodiment of the device of the present invention with a tabletop rotated horizontally.
Figure 7:
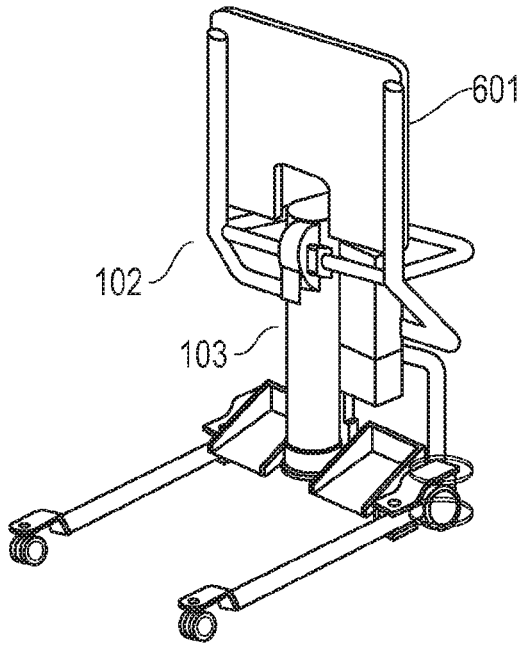
FIG. 7 shows a perspective view of one embodiment of the device of the present invention with a tabletop rotated vertically.

Reference is now made to FIG. 6 and FIG. 7, which show a perspective view of one embodiment of the device of the present invention with a tabletop 601. In this embodiment, a tabletop 601 may be easily attached to, and removed from, the arms 120 of the frontal bars 102. When the tabletop 601 is attached to the frontal bars 102, the frontal bars 102 may be rotated so that the arms 120 and the attached tabletop 601 extend horizontally, as shown in FIG. 6. In this horizontal position, the tabletop 601 may be used as table. The tabletop 601 may also be raised and lowered by the central upright structure 104 of the lift cart 103. For example, the tabletop 601 may be raised to an appropriate height for use as an over-the-bed table or lowered to a height appropriate for use as a bedside table. The frontal bars 102 may also be rotated, when the tabletop 601 is attached to the frontal bars 102, so that the arms 120 and the attached tabletop 601 extend vertically, as shown in FIG. 7. For example, the lift cart 103 may be easily stored when the frontal bars 102 and tabletop 601 are in a vertical position.

Figure 8A:
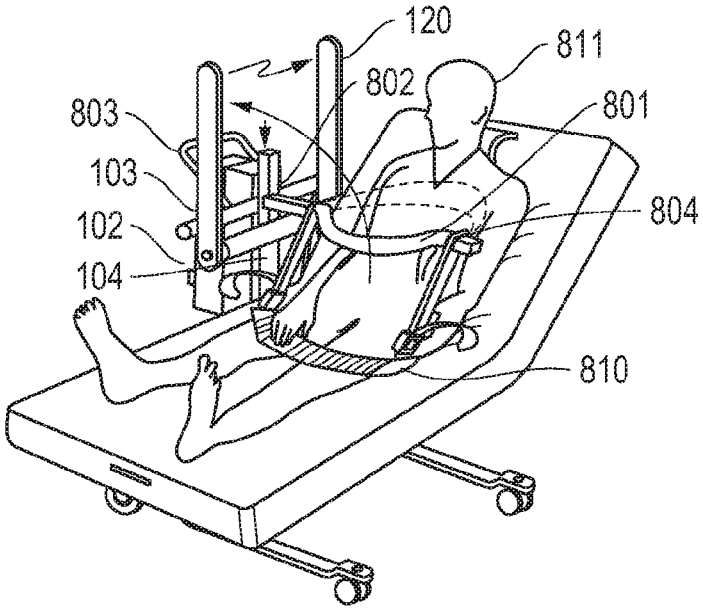
FIG. 8*a* shows a perspective view of one embodiment of a central arm of one embodiment of the device of the present invention.

Reference is now made to FIG. 8*a*, which shows a perspective view of one embodiment of a central arm 801 of one embodiment of the device of the present invention. In FIG. 8*a*, the central arm 801 is shown to attach to the central structure 104 of the lift cart 103 and extend horizontally from the central structure 104. In one embodiment, the central arm extends in a direction that is approximately parallel to the direction of the arms 120 of the frontal bars 102 extend when the arms 120 are rotated horizontally. A patient 811 may grip the central arm 801 for support and patient interfaces 810 may connect to the central arm 801 in order to support a patient 811. The central arm 801 may connect to the central structure 104 with or without frontal bars 102 attached to the central structure 104. In one embodiment, the central arm 801 may permanently attach to the lift cart 103. In other embodiments, the central arm 801 may be easily attached to, and removed from, the lift cart 103.

Figure 8B:
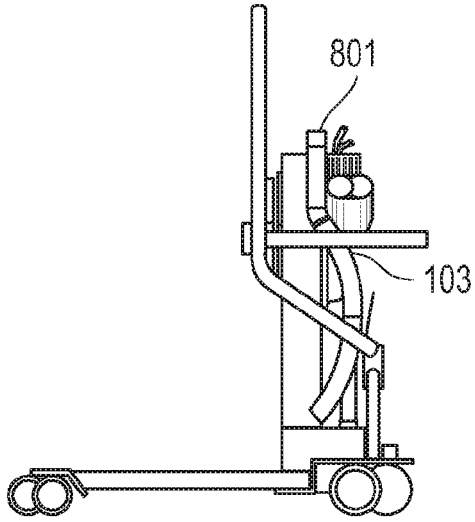
FIG. 8*b* shows a side view of one embodiment of a central arm of one embodiment of the device of the present invention.

Reference is now made to FIG. 8*b*, which shows a side view of one embodiment of a central arm 801 of one embodiment of the device of the present invention. In one embodiment, the central arm 801 may also attach vertically to the lift cart 103, such as shown in FIG. 8*b*. For example, the central arm 801 may be attached in a vertical position to the lift cart 103 in order to store the central arm 801 on the lift cart 103 when the central arm 801 is not being used. In one embodiment, a tabletop may connect to the central arm 801.

The shape of the central arm 801 may vary in different embodiments of the device of the present invention. Referring again to FIG. 8*a*, the central arm 801 is shown to contain a proximal end 802 that can attach to the central structure 104. In this embodiment, the shape of the proximal end 802 includes a right angle 803 that allows a portion of the proximal end 802 to be inserted into a vertical receptacle in the central structure 104 and allows the distal portion 804 of the central arm 801 to extend horizontally.

Figure 8C:
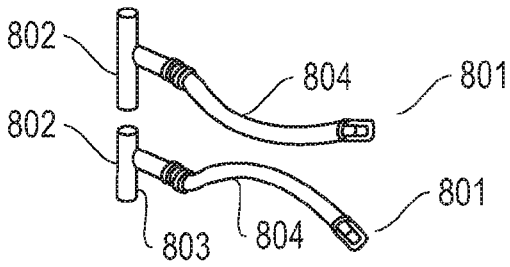
FIG. 8*c* shows a perspective view of example embodiments of a central arm of one embodiment of the device of the present invention.

Reference is now made to FIG. 8*c*, which shows a perspective view of example embodiments of a central arm 801 of one embodiment of the device of the present invention. In FIG. 8*c*, one embodiment of the central arm 801 is shown in which the right angle 803 may rotate relative to the distal portion 804 of the central arm 801.

Figure 8D:
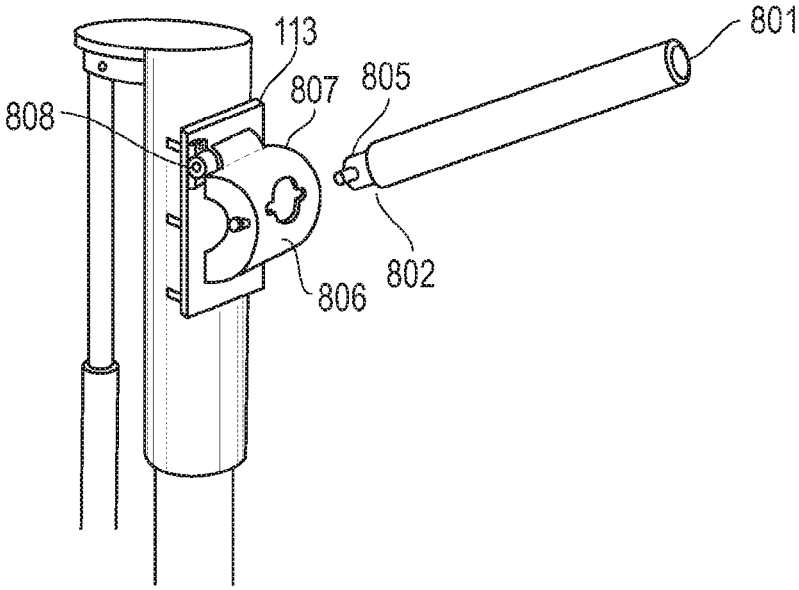
FIG. 8*d* shows a perspective view of one embodiment of a central arm and a safety mechanism of one embodiment of the device of the present invention.

Reference is now made to FIG. 8*d*, which shows a perspective view of one embodiment of a central arm 801 and a safety mechanism 807 of one embodiment of the device of the present invention. In FIG. 8*d*, the proximal end 802 of the central arm 801 is shown to include a connector 805. In this embodiment, a corresponding mating connector 806 is included in a safety mechanism 807. The safety mechanism 807 is shown to attach to the attachment plate 113. In this embodiment, the safety mechanism 807 is hinged 808 to the attachment plate 113.

Figure 8E:
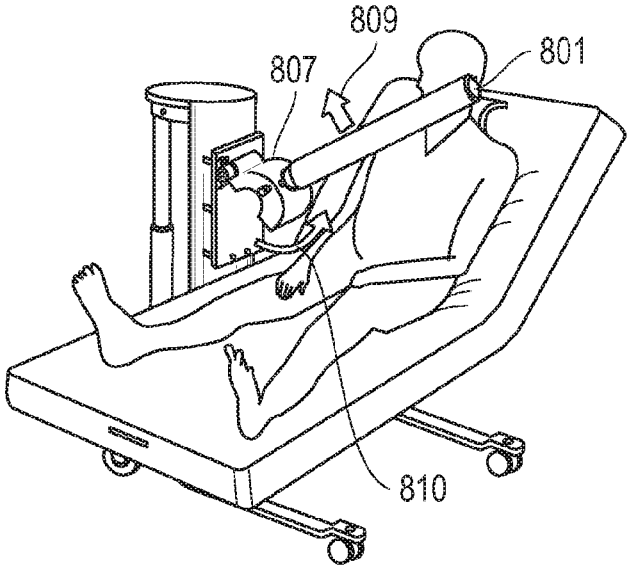
FIG. 8*e* shows an example of the method of operating one embodiment of a central arm and a safety mechanism of one embodiment of the device of the present invention.

Reference is now made to FIG. 8*e*, which shows an example of the method of operating one embodiment of a central arm 801 and a safety mechanism 807 of one embodiment of the device of the present invention. In FIG. 8*e*, the central arm 801 and safety mechanism 807 are shown to pivot upwards 809 in the event that an upwardly directed force 810 is applied to the underside of the central arm 801. For example, in the event that an upwardly directed force 810 is applied to the underside of the central arm 801, such as if the central arm 801 were to be mistakenly lowered onto a patient's leg, the safety mechanism 807 will move upwards so that the central arm 801 also moves upwards. It can be appreciated that other embodiments may include other types of attachment mechanisms and safety mechanisms without departing from the spirit and scope of the invention.

Referring again to FIG. 8*a*, the shape of the central arm 801 may also include curves. In one embodiment, the distal portion 804 of the central arm 801 is curved in a horizontal plane. The degree of curvature of the distal portion 804 of the central arm 801 shown in this embodiment generally approximates the curvature of a patient's chest. In one embodiment, the direction of the curvature of the central arm 801 relative to the lift cart 103 may be adjusted. For example, in one embodiment, the distal portion 804 of the central arm 801 may be rotated at least 180 degrees about the longitudinal axis of the central arm 801, such as shown in FIG. 8*c*. In an alternative embodiment, the proximal end 802 of the central arm 801 may attach to the central structure 104 in alternate orientations in order to allow the direction of the curvature of the central arm 801 to be adjusted. A caregiver may, for example, adjust the direction of the curvature of the central arm 801 so that the direction of curvature will be concave from the perspective of a patient 811, regardless of the position of the lift cart 103 relative to the patient 811. For example, the direction of curvature may be adjusted depending on whether the lift cart 103 is positioned to the left or right side of a patient 811. As will be described in more detail below, the central arm 801 may be used to transfer a patient 811 from either side of a patient 811 and with the central arm 801 extending horizontally across the front of the patient 811 and positioned approximately between the height of the head and knees of the patient 811. A variety of patient interfaces 812 may also be attached to the central arm 801.

Figure 9:
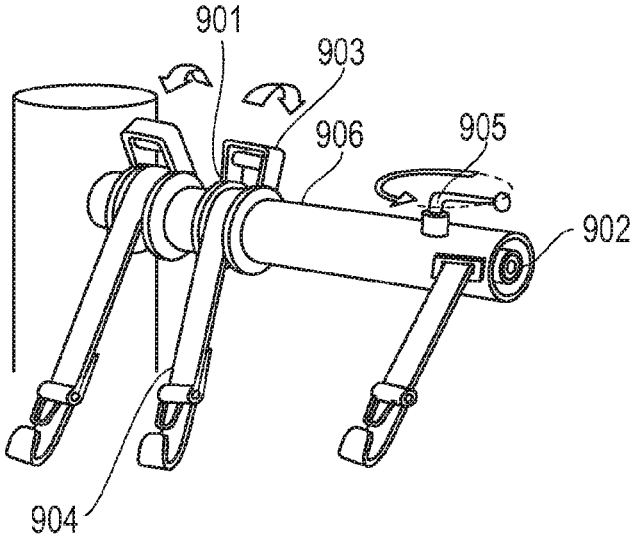
FIG. 9 shows a front view of example embodiments of winches of one embodiment the device of the present invention.

Reference is now made to FIG. 9, which shows a front view of example embodiments of winches 901 and 902 of one embodiment of the device of the present invention. A first example arm 906 is shown as a partial representation of the central arm 801 and/or an arm 120 of the frontal bars 102. The first example arm 906 may include one or more winches 901 and 902. In one embodiment, a ratchet winch 901 may be attached to the outer surface of the first example arm 906. The ratchet winch 901 may also include a brake/release mechanism 903 that controls the length of the webbing 904 that may extend from the first example arm 906. In one embodiment, an internal worm winch 902 may be included inside the first example arm 906. The internal worm winch 902 may also include a switch 905 that controls the length of the webbing 904 that may extend from the first example arm 906.

Figure 10:
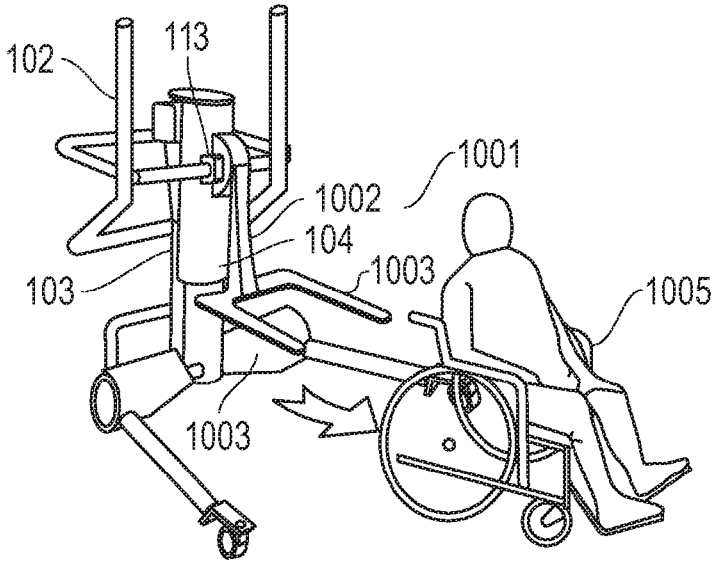
FIG. 10 shows a perspective view of a first example embodiment of a lift fork of one embodiment of the device of the present invention.

Reference is now made to FIG. 10, which shows a perspective view of a first example embodiment of a lift-fork 1001 of the device of the present invention. Referring to FIG. 10, a lift-fork 1001 capable of supporting a wheelchair 1005 is shown attached to the central structure 104 of the lift cart 103. In this embodiment, the lift-fork 1001 includes a vertical extension arm 1002 so that the forks 1003 of the lift-fork 1001 extend horizontally at a height that is below the point of attachment 1004 of the lift-fork 1001 to the central structure 104. The lift-fork 1001 may attach to the attachment plate 113 with or without frontal bars 102 also attached to the central structure 104. When the lift-fork 1001 is attached to the central structure 104, the lifting mechanism of the central structure 104 can raise and lower the lift-fork 1001. If the lift-fork 1001 is used to support a wheelchair 1005, the lift cart 103 can raise and lower the wheelchair 1005, and optionally a patient supported by the wheelchair 1005, such as in connection with, for example, a transfer of the wheelchair 1005 to and from locations of different elevations.

Figure 11:
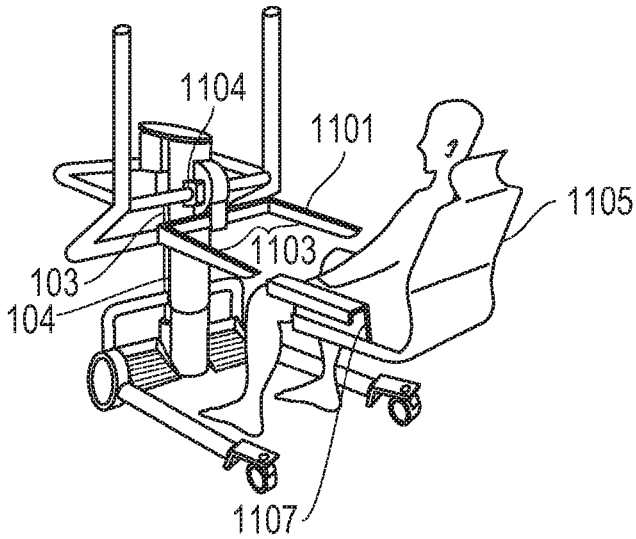
FIG. 11 shows a perspective view of a second example embodiment of a lift-fork of one embodiment of the device of the present invention.

Reference is now made to FIG. 11, which shows a perspective view of a second example embodiment of a lift-fork 1101 of one embodiment of the device of the present invention. In this embodiment, the lift-fork 1101 does not include a vertical extension arm 1002. Consequently, the forks 1103 of the lift-fork 1101 extend horizontally at a height that may be approximately equal to, or slightly below or slightly above, the point of attachment 1104 of the lift-fork 1101 to the central structure 104. In this embodiment, the lift-fork 1101 may support a rigid patient interface 1105, for example, by sliding the forks 1103 of the lift-fork 1101 into receptacles 1107 of the rigid patient interface 1105. If the lift-fork 1101 is used to support a rigid patient interface 1105, the lift cart 103 can raise and lower the lift-fork 1101, the rigid patient interface 1105, and optionally a patient supported by the rigid patient interface 1105, such as in connection with, for example, a transfer of the rigid interface 1105 to and from locations of different elevations.

Figure 12:
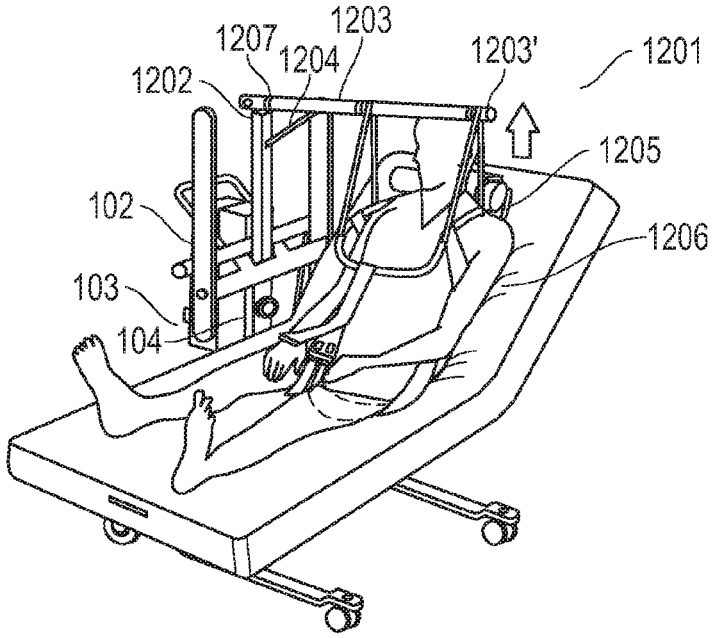
FIG. 12 shows a perspective view of one embodiment of a hoist of one embodiment of the device of the present invention.

Reference is now made to FIG. 12, which shows a perspective view of one embodiment of a hoist 1201 of one embodiment of the device of the present invention. In this embodiment, a hoist 1201 is shown attached to the central structure 104 of the lift cart 103. The hoist 1201 may contain a vertical extension arm 1202 and a horizontal support arm 1203. In one embodiment, the horizontal support arm 1203 may consist of a central arm 801 that is adapted to connect to a vertical extension arm 1202. In one embodiment, the shape of the horizontal support arm 1203 may be arched to provide, for example, additional head room for a patient 1206. In one embodiment, the vertical extension arm 1202 and the horizontal support arm 1203 may be connected together with a hinge 1207. In one embodiment, the vertical extension arm 1202 and the horizontal support arm 1203 may be folded together or separated from one another when not in use. The hoist 1201 may also include an angled support bar 1204 in order to, for example, increase the amount of weight that may be supported by the horizontal support arm 1203. In one embodiment, the hoist 1201 may include a means for allowing the distal end 1203' of the horizontal support arm 1202 to pivot above or below horizontal. For example, in one embodiment, the angled support bar 1204 may include a hydraulic cylinder that may extend to raise the distal end 1203' of the horizontal support arm 1203 and retract to lower the distal end 1203' of the horizontal support arm 1203.

The vertical extension arm 1202 may attach to the lift cart 103 by, for example, insertion of the vertical extension arm 1202 into a receptacle in the central structure 104. The vertical extension arm 1202 may attach to the lift cart 103 with or without frontal bars 102 also attached to the central structure 104. The horizontal support arm 1203 may support a patient 1206 by allowing the patient 1206 to grip the horizontal support arm 1203 or by connecting to patient interfaces 1205 that support the patient 1206. A variety of patient interfaces 1205 may be attached to the horizontal support arm 1203. In FIG. 12, the patient interface 1205 is shown to be suspended from the horizontal support arm 1203. As will be described in more detail below, the hoist 1201 may be used to transfer a patient 1206 laterally from either side of the patient 1206.

Figure 13:
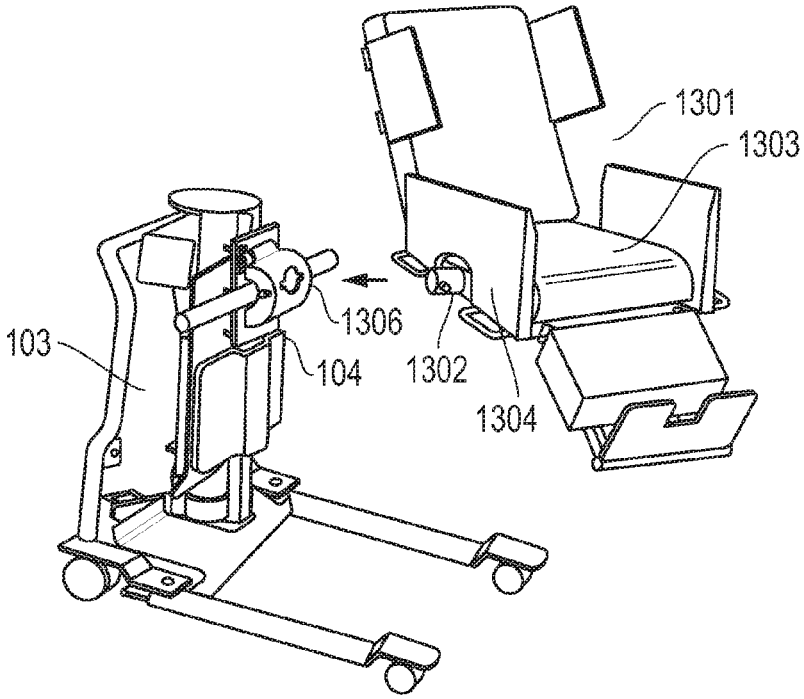
FIG. 13 shows a perspective view of one embodiment of a transfer chair of one embodiment of the device of the present invention.

Reference is now made to FIG. 13, which shows a perspective view of one embodiment of a transfer chair 1301 of the device of the present invention. In this embodiment, the transfer chair 1301 may attach directly to the lift cart 103. The transfer chair 1301 is shown to include a connector 1302 on the side 1304 of the seat portion 1303 of the transfer chair 1301. Alternatively, the transfer chair 1301 may include a connector 1302 on either or both sides 1304 of the seat portion 1303 of the transfer chair 1301 and/or on the back side 1305 of the seat portion 1303 of the transfer chair 1301. In this embodiment, the connector 1302 may be connected to a mating connector 1306 in the central structure 104 of the lift cart 103. It can be appreciated that other embodiments may include other types of connection mechanisms without departing from the spirit and scope of the invention.

Figure 14:
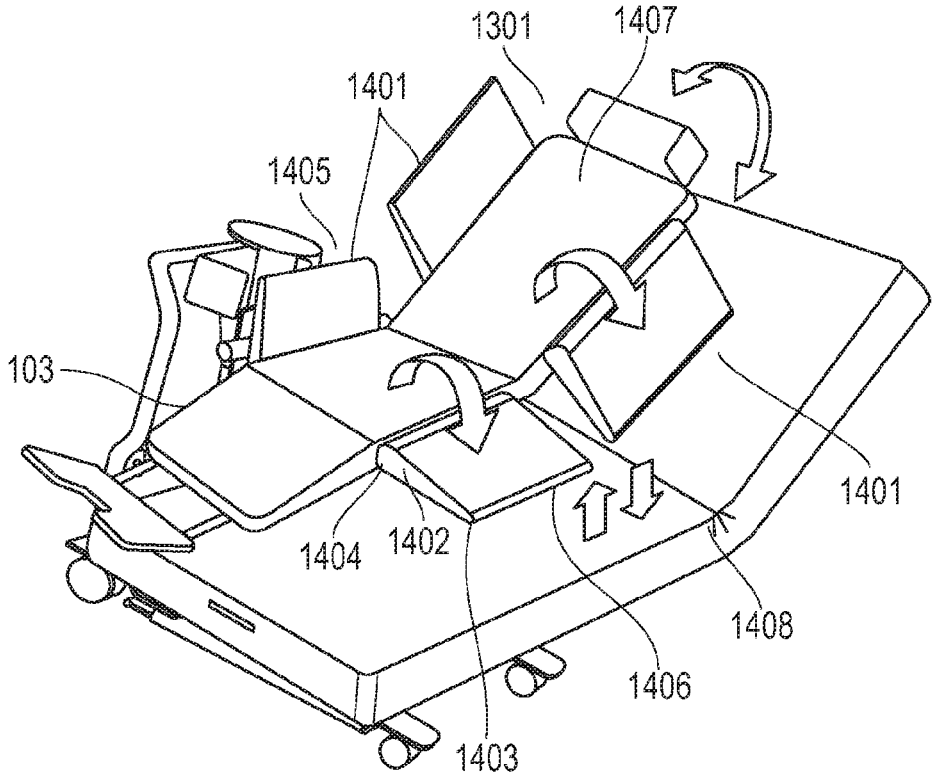
FIG. 14 shows a perspective view of one embodiment of a transfer chair connected to a lift cart of one embodiment of the device of the present invention.

Reference is now made to FIG. 14, which shows a perspective view of one embodiment of a transfer chair 1301 connected to a lift cart 103 of one embodiment of the device of the present invention. Once the transfer chair 1301 is connected to the lift cart 103, the lift cart 103 may raise and lower the transfer chair 1301 in order to, for example, transfer a patient to and from locations at different elevations. In this embodiment, the sides 1401 of the transfer chair 1301 are hinged 1404. The sides 1401 may rotate between a position that is approximately perpendicular 1405 with the upper surface 1407 of the portion of the transfer chair 1301 to which the side 1401 is connected and a position that is approximately parallel 1406 with the upper surface 1407 of the portion of the transfer chair 1301 to which the side 1401 is connected. For example, the sides 1401 may be rotated a position that is approximately perpendicular 1405 with the upper surface 1407 of the portion of the transfer chair 1301 to which the sides 1401 are connected in order to help secure a patient within the boundaries of the upper surfaces 1407 of the transfer chair 1301. In addition, the sides 1401 may be rotated to a position that is approximately parallel 1406 with the upper surfaces 1407 of the portion of the transfer chair 1301 to which the sides 1401 are connected in order to assist a patient transitioning between the transfer chair 1301 and another location such as a bed 1408. In one embodiment, the sides 1401 are removable from the transfer chair 1301. In one embodiment, the width of the sides 1401 of the transfer chair 1301 may be varied. In FIG. 14, for example, the width of the sides 1401 decreases from the proximal end 1402 of the sides 1401 to the distal end 1403 of the sides in 1401 order to, for example, assist a patient sliding from the transfer chair 1301 to a bed 1408.

Figure 15:
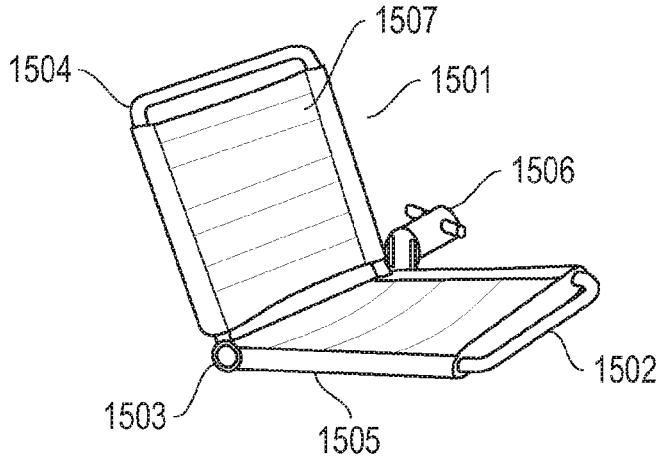
FIG. 15 shows a perspective view of a second example embodiment of the transfer chair of one embodiment device of the present invention.

Reference is now made to FIG. 15, which shows a second example embodiment of a transfer chair 1501 of one embodiment of the device of the present invention. In this embodiment, the transfer chair 1501 includes a rigid frame 1502. The rigid frame 1502 is shown to include hinges 1503 that allows the back portion 1504 of the rigid frame 1502 to recline in relation to the seat portion 1505 of the rigid frame 1502. The reclining position of the transfer chair 1501 may also be assisted and controlled by alternative means such as by use of a locking gas spring, an actuator, hydraulic cylinder, adjustable straps, or zero-gravity system. The transfer chair 1501 is also shown to include a connector 1506 that may attach to the hinges 1503 or the seat portion 1505 of the rigid frame 1502. The transfer chair 1501 may also include fabric 1507 attached to the rigid frame 1502.

Figure 16A:
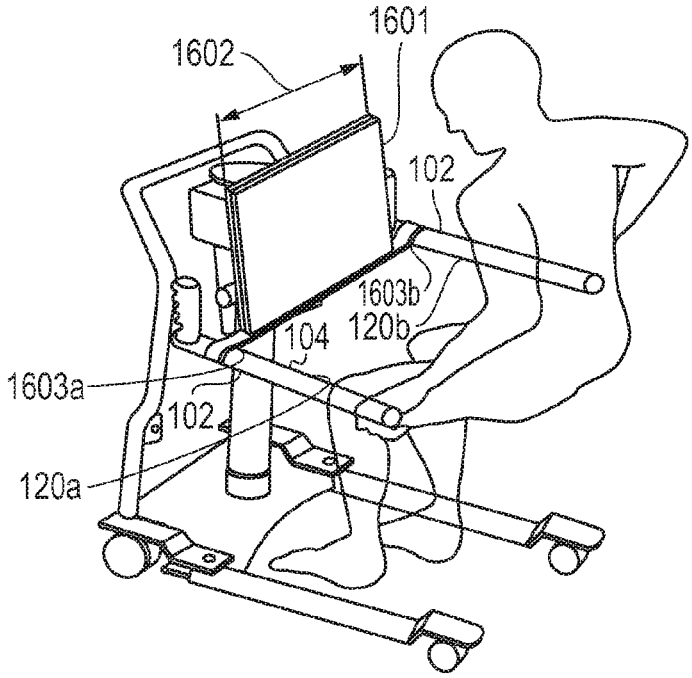
FIG. 16*a* shows a perspective view of one embodiment of a frontal bar cushion of one embodiment of the device of the present invention.

Reference is now made to FIG. 16*a*, which shows a perspective view of one embodiment of a frontal bar cushion 1601 of one embodiment of the device of the present invention. In FIG. 16*a*, the frontal bar cushion 1601 is shown to be generally rectangular in shape with a width 1602 that is slightly less than the distance between the arms 120 of the frontal bars 102. The frontal bar cushion 1601 may also include a means for attaching the frontal bar cushion 1601 to the frontal bars 102 or the central structure 104. In this embodiment, the frontal bar cushion 1601 includes two straps 1603. For example, a strap 1603*b* at the bottom right corner of the frontal bar cushion 1601 may connect to the right arm 120*b* of the frontal bars 102 and a strap 1603*a* at the bottom left corner of the frontal bar cushion 1601 may connect to the left arm 120*a* of the frontal bars 102. In this embodiment, the straps 1603 also support the frontal bar cushion 1601 so that the frontal bar cushion 1601 rests above the horizontal plane of the arms 120 of the frontal bars 102 when the frontal bars 102 are rotated horizontally.

Figure 16B:
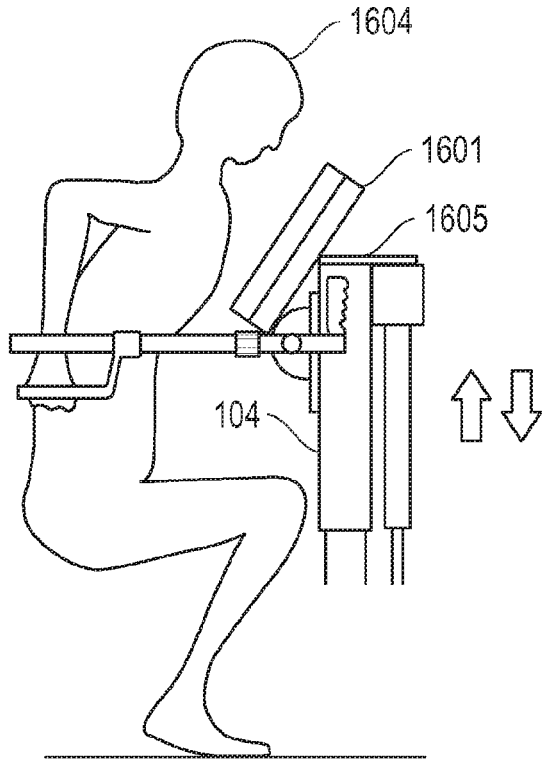
FIG. 16*b* shows a side view of one embodiment of a frontal bar cushion connected to horizontally extending frontal bars of one embodiment of the device of the present invention.

Reference is now made to FIG. 16*b*, which shows a side view of one embodiment of a frontal bar cushion 1601 connected to horizontally extending frontal bars 102 of one embodiment of the device of the present invention. In FIG. 16*b*, the frontal bar cushion 1601 is also shown to rest against the top of the central structure 104 at an angle so as to prevent a patient 1604 from bumping against the top 1605 of the central structure 104.

Figure 16C:
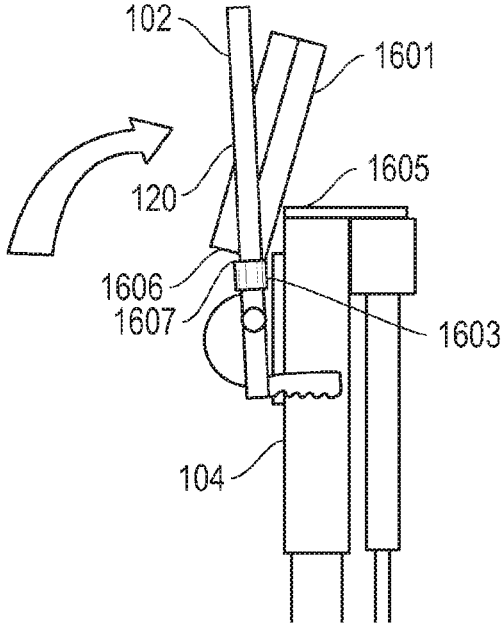
FIG. 16*c* shows a side view of one embodiment of a frontal bar cushion connected to vertically extending frontal bars of one embodiment of the device of the present invention.

Reference is now made to FIG. 16*c*, which shows a side view of one embodiment of a frontal bar cushion 1601 connected to vertically extending frontal bars 102 of one embodiment of the device of the present invention. In FIG. 16*c*, the arms 120 of the frontal bars 102 are rotated towards vertical, the frontal bar cushion 1601 will continue to rest against the top 1605 of the central structure 104 even though the bottom 1606 of the frontal bar cushion 1601 may rise. For example, the bottom 1606 may rise the same amount that the arms 120 of the frontal bars 102 rise at the point of attachment 1607 of the straps 1603 to the frontal bars 102. In addition, the slope of the frontal bar cushion 1601, as it rests against the central structure 104, may increase. The height and width of the frontal bar cushion 1601 may vary.

Figure 17A:
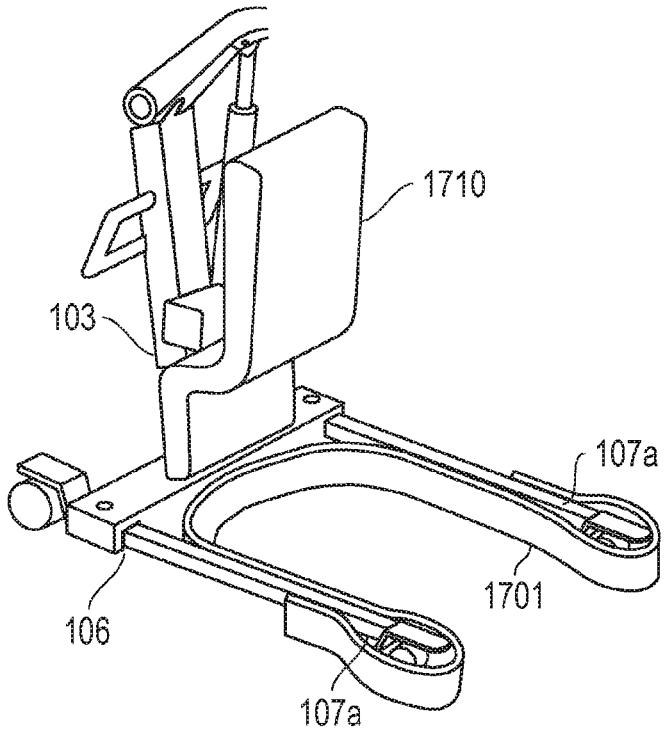
FIGS. 17*a-c* show perspective views of example embodiments of safety cushions of one embodiment of the device of the present invention.
Figure 17B:
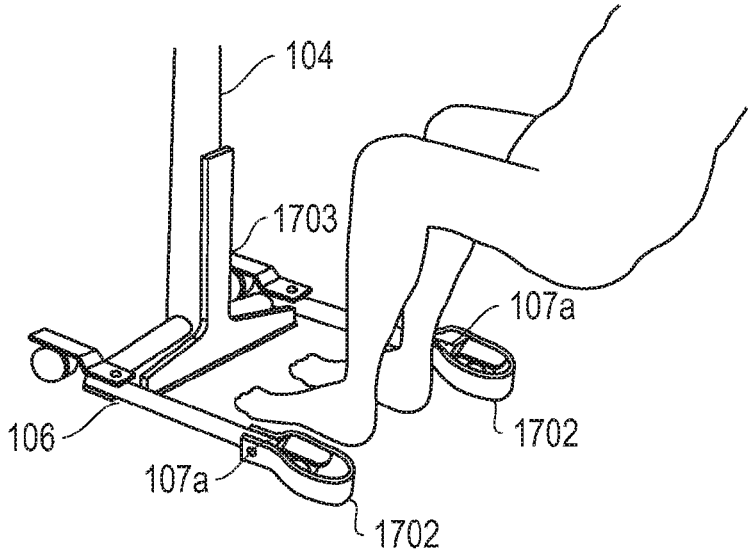
Figure 17C:
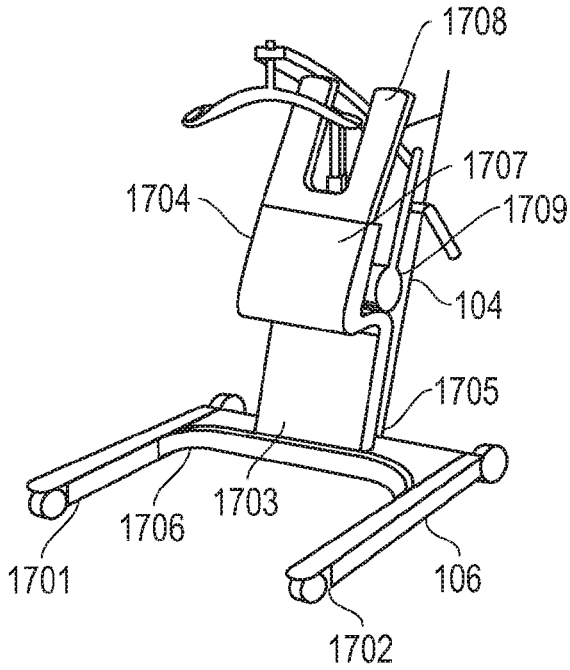

Reference is now made to FIGS. 17*a-c*, which show perspective views of example embodiments of safety cushions of one embodiment of the device of the present invention. In FIG. 17*a*, a safeguard cushion 1701, shown shaped in a strip for example, may cover the interior of the u-shaped frame 106 and the distal portion 107*a* of the legs 107. In one embodiment, the safeguard cushion 1701 may flexibly bend if the legs 107 of the lift cart 103 are spread apart and straighten if the legs 107 are moved closer together. One embodiment of an s-shaped cushion 1710 is also shown.

In FIG. 17*b*, a wheel cushion 1702, shaped in a strip, covers each distal portion 107*a* of the legs 107. In another embodiment, a base cushion 1703 may cover at least a portion of the interior of the u-shaped frame 106 and also extend upwards to cover at least a portion of the central structure 104.

In FIG. 17*c*, another embodiment of an s-shaped cushion 1704 may attach to the central structure 104. The first straight portion 1705 of the s-shaped cushion 1704 covers a portion of the bottom of the central structure 104. The curved section 1706 of the s-shaped cushion 1704 extends over a feature 1709 of the central structure 104 that protrudes laterally from the central structure 104. Also, a second straight portion 1707 of the s-shaped cushion 1704 extends upwards to cover portions of the central structure 104 and/or a portion of the protruding feature 1709. The s-shaped cushion 1704 may also include a lower portion 1706 that covers at least a portion of the interior of the u-shaped frame 106. The s-shaped cushion 1704 may also include an upper portion 1708. In one embodiment, the upper portion 1708 is transparent. Embodiments of the above referenced safety cushions—including the safeguard cushion 1701, the wheel cushion 1702, the base cushion 1703, the s-shaped cushion 1704, the alternate s-shaped cushion 1710, and portions of each of the aforementioned—may be employed individually or in combination to improve, for example, the safety or comfort of the operation of the lift cart.

Figure 18A:
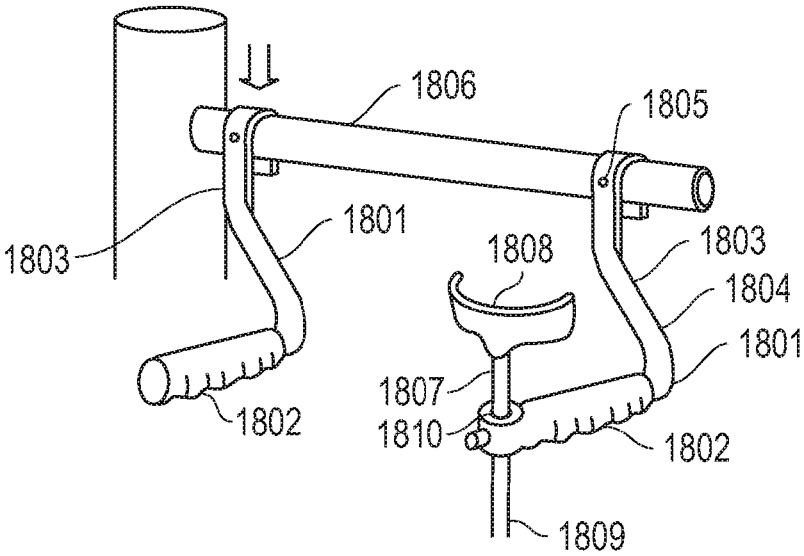
FIGS. 18*a-d* show perspective views of example embodiments of detachable handles of one embodiment of the device of the present invention.

Reference is now made to FIGS. 18*a-d*, which show perspective views of example embodiments of detachable handles 1801 of one embodiment of the device of the present invention. In FIG. 18*a*, two example detachable handles 1801 are shown attached to a second example arm 1806. The second example arm 1806 is shown as a partial representation of the central arm 801 or an arm 120 of the frontal bars 102. In this embodiment, the detachable handles 1801 include a handle 1802 at their distal end and a hook 1803 at their proximal end. The hook 1803 may clip onto the second example arm 1806. In this embodiment, the detachable handles 1801 are shaped to include a straight portion 1803 and a curved portion 1804 so that the handle 1802 extends horizontally when the hook 1803 is fastened to the second example arm 1806. In one embodiment, the detachable handle 1801 may include a locking mechanism 1805. The locking mechanism in this embodiment is shown to be a push-button lock. The locking mechanism 1805 may also be positioned at different orientations so that when the detachable handle 1801 fastens to the arm 1806 the handle 1802 may extend at angles other than horizontal. In one embodiment, the handle 1802 may also include an arm support 1807. In this embodiment, the arm support 1807 includes an open cuff 1808 and an extension rod 1809. The extension rod 1809 is shown to extend through an opening 1810 in the handle 1802 and to be fastened in place by an additional locking mechanism 1805. The height of the open cusp 1808 relative to the handle 1802 may be adjusted by securing the locking mechanism 1805 at different points along the extension rod 1809.

Figure 18B:
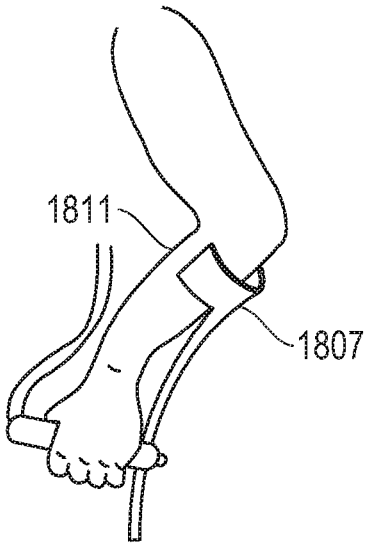

In FIG. 18*b*, an embodiment of the arm support 1807 is shown supporting a forearm 1811.

Figure 18C:
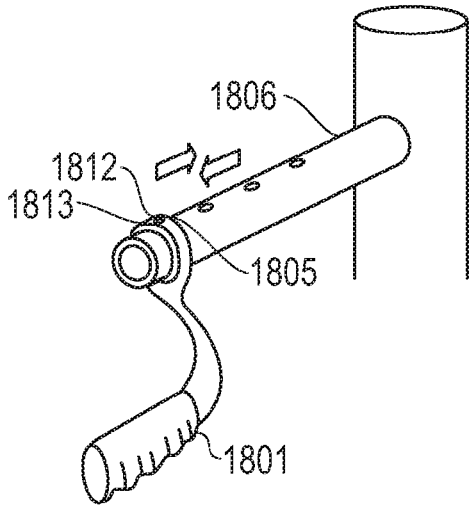

In FIG. 18*c*, an alternative embodiment of a detachable handle 1801 is shown. In this embodiment, the detachable handle 1801 includes a ring 1812 for fastening the detachable handle 1801 to the second example arm 1806. The ring 1812 may include a clasp 1813 that allows the ring 1812 to open and fasten to the second example arm 1806 at multiple locations. The ring 1812 may also include a locking mechanism 1805.

Figure 18D:
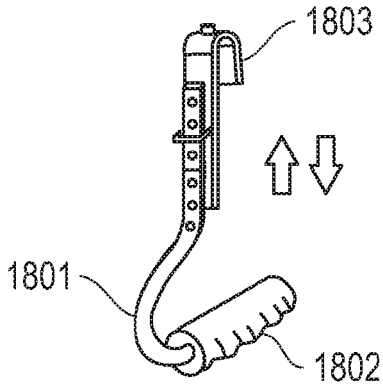

In FIG. 18*d*, an alternative embodiment of the detachable handle 1801 is shown. In this embodiment, the handle 1802 and the hook 1803 of the detachable handle 1801 exist as separate components that may be fastened together. In this embodiment, the height of the handle 1802 relative to the hook 1803 may be varied and the yaw of the handle 1802 may be varied. It can be appreciated that other embodiments of the detachable handle may include other types of locking mechanisms and/or connection mechanisms without departing from the spirit and scope of the invention.

Figure 19:
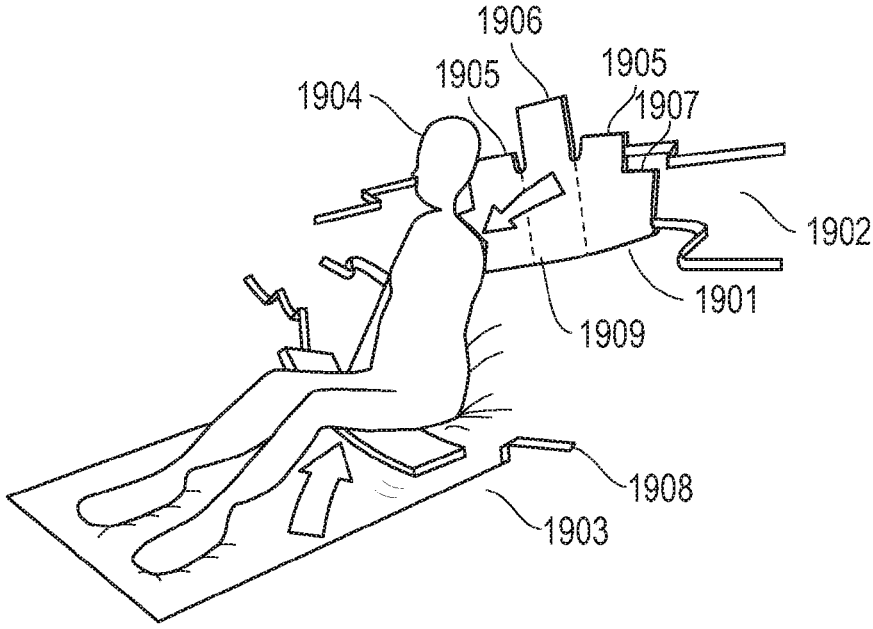
FIG. 19 shows a perspective view of one embodiment of the patient interface of one embodiment of the device of the present invention.

Reference is now made to FIG. 19, which shows a perspective view of one embodiment of the patient interface 1901 of one embodiment of the device of the present invention. In this embodiment, the patient interface 1901 includes a backrest sling 1902, a thigh sling 1903 and straps 1908. The backrest sling 1902 may be positioned on the upper back of a patient 1904. In one embodiment, the backrest sling 1902 may include shoulder flaps 1905, a neck flap 1906, and/or slide flaps 1907. The thigh sling 1903 may be positioned underneath the thighs of a patient 1904. The straps 1908 may connect together and may connect to the lift cart 103 or to lift components.

In one embodiment, components of the patient interface 1901 may include semi-rigid articulated panels 1909. For example, the backrest sling 1902 may be reinforced with semi-rigid articulated panels 1909 in order to assist with the positioning of the back-rest sling 1902 under a patient 1904. The semi-rigid articulated panels 1909 may assist with the direct positioning of the patient interface 1901 under a patient 1904 or with the positioning of the patient interface 1901 under a patient 1904 by means of log-rolling the patient 1904 onto the patient interface 1901.

Figure 20A:
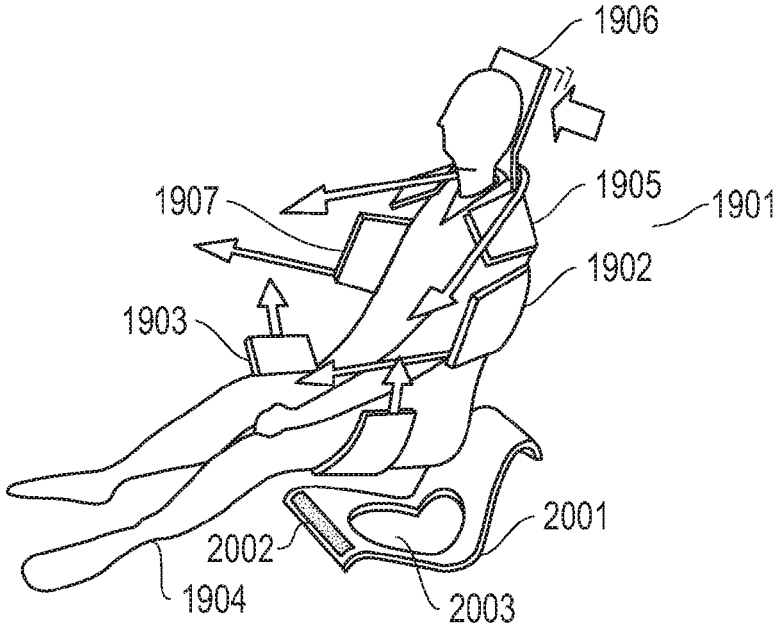
FIG. 20*a* shows a perspective view of one embodiment of the patient interface of one embodiment of the device of the present invention.

Reference is now made to FIG. 20*a*, which shows a perspective view of one embodiment of the patient interface 1901 of one embodiment of the device of the present invention. In this embodiment, the patient interface 1901 includes a backrest sling 1902, a thigh sling 1903, straps 1908 and a buttock/link support 2001. The buttock/link support 2001 may connect to the backrest sling 1902 and the thigh sling 1903. For example, the buttock/link support 2001 may connect to the backrest sling 1902 and the thigh sling 1903 by means of Velcro attachment mechanism 2002. The buttock/link support 2001 may also include a cutaway portion 2003. For example, the cutaway portion 2003 may be positioned to allow a patient 1904 to urinate or defecate without removing the patient interface 1901. In FIG. 20*a*, the side flaps 1907 have been pulled around the sides of the patient 1904 and the shoulder flaps 1905 have been pulled over the shoulders of the patient 1904. The side flaps 1907 may be placed under or over the arms of a patient 1904. The neck flap 1906 is also shown to support the neck and head of the patient 1904. In one embodiment, tightening straps 1908 around the shoulder flaps 1905 serves to position the neck flap 1906 against the neck and head of the patient 1904. In one embodiment, the straps 1908 may be adjusted to change the position of the patient 1904. For example, tightening the straps 1908 may allow the patient 1904 to sit in a tucked seated position and loosening the straps 1908 may allow the patient to lie in an open position.

Figure 20B:
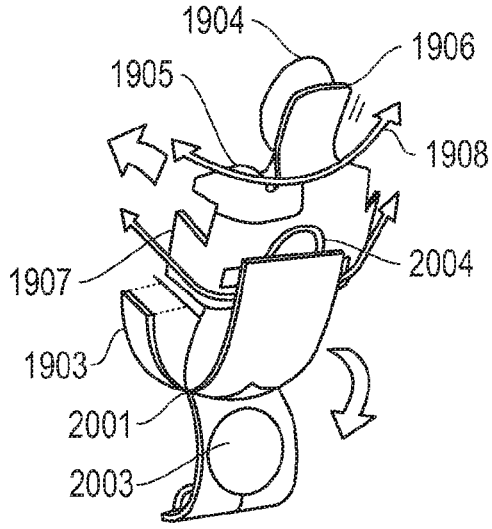
FIG. 20*b* shows a second perspective view of one embodiment of the patient interface of one embodiment of the device of the present invention.

Reference is now made to FIG. 20*b*, which shows a second perspective view of one embodiment of the patient interface 1901 of one embodiment of the device of the present invention. In one embodiment, the buttock/link support 2001 may also include a handle 2004. In one embodiment, the patient interface 1901 may include the buttock/link support 2001 and two or more of the following: a backrest sling 1902, a thigh sling 1903, straps 1908.

Figure 21A:
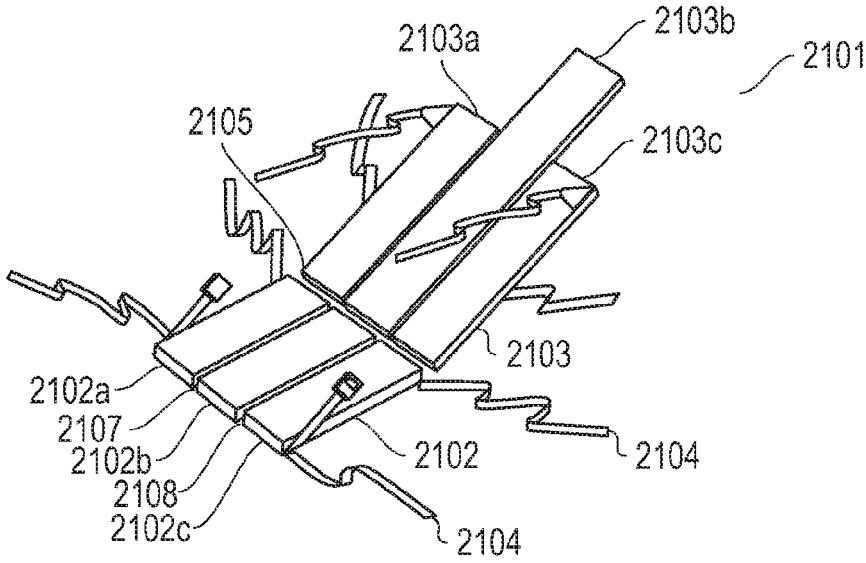
FIGS. 21*a-d* show perspective views of one embodiment of a foldable patient interface of one embodiment of the device of the present invention.
Figure 21B:
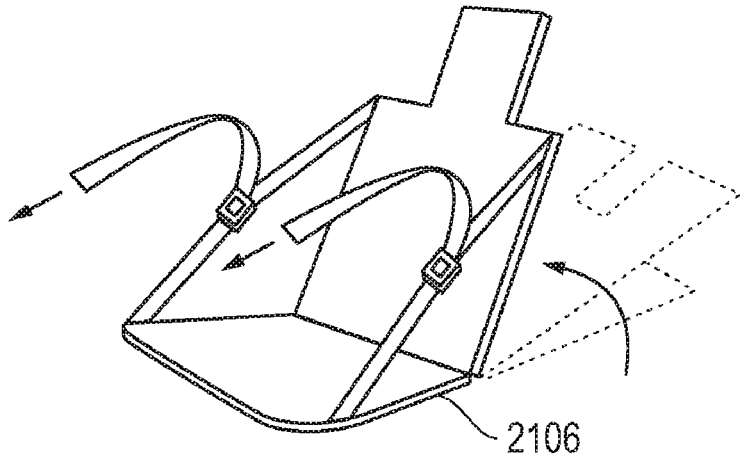
Figure 21C:
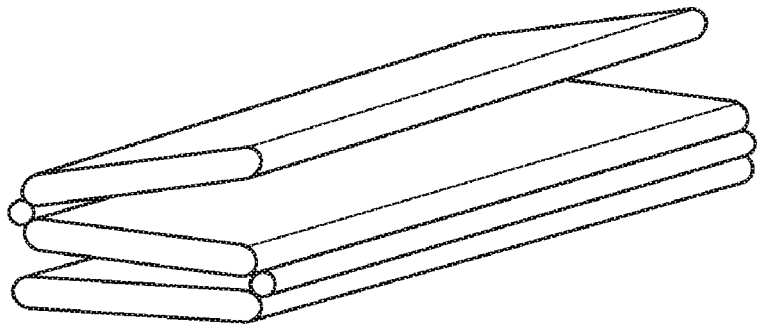

Reference is now made to FIGS. 21*a-d*, which show perspective views of one embodiment of a foldable patient interface 2101 of one embodiment of the device of the present invention. In this embodiment, the foldable patient interface 2101 is shown to include a seat portion 2102 and a back portion 2103, each containing straps 2104 and three panels 2102*a,b*,&*c* and 2103*a,b*,&*c*. The seat portion 2102 and the back portion 2103 may fold together or apart along a lateral crease 2105. For example, the seat portion and the back portion may fold along the lateral crease to form a chair 2106, as shown in FIG. 21*b*. In addition, the panels of the seat portion 2102*a,b*,&*c* and the panels of back portion 2103*a,b*, &*c* may also fold along a first lengthwise crease 2107 and a second lengthwise crease 2108. For example, the panels of the seat portion and the panels of back portion may fold along the first and second lengthwise crease, as shown in FIG. 21*c*.

Figure 21D:
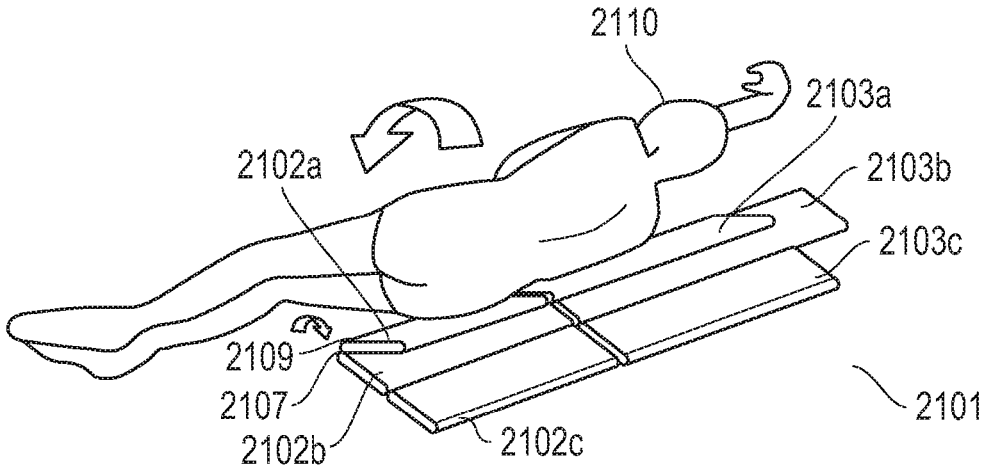

In FIG. 21*d*, one means for placing the foldable patient interface 2101 underneath a patient is shown. The foldable patient interface 2101 is shown to be folded along the first lengthwise crease 2107 with the outside panels 2102*a* and 2103*a* resting on top of the middle panels 2102*b* and 2103*b*, respectively. The outer edge 2109 of the first lengthwise crease 2107 is shown to be placed under the right side of a patient 2110. In this embodiment, the patient 2110 is resting on her right side and the first lengthwise crease 2107 is placed under the patient 2110 from the direction of the patient's backside. From this position, the patient 2110 may roll over the folded outside panels 2102*a* and 2103*a* and the middle panels 2102*b* and 2103*b* to rest with her left side against the outside panels 2102*c* and 2103*c*. While the patient 2110 is on her left side, the outside panels 2102*a* and 2103*a* can be unfolded from the middle panels 2102*b* and 2103*b* and the patient 2110 may roll onto her back with the patient interface 2101 correctly positioned underneath the patient 2110.

Figure 21E:
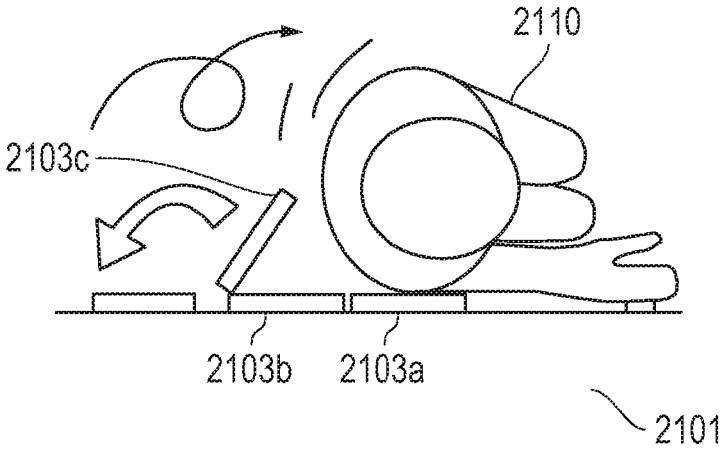
FIG. 21*e* shows an end view of one embodiment of a foldable patient interface of one embodiment of the device of the present invention.

Reference is now made to FIG. 21*e*, which shows an end view of one embodiment of a foldable patient interface 2101 of one embodiment of the device of the present invention. The end view of FIG. 21*e* only shows the ends of the panels 2103*a,b*&c of the back portion 2103. In this embodiment, however, panels 2102*a* and 2103*a* have been inserted underneath the patient 2110 with panels 2102*c* and 2103*c* folded on top of 2102*b* and 2103*b*. After panels 2102*c* and 2103*c* have been unfolded, the patient 2110 may roll onto her back with the patient interface 2101 correctly positioned underneath the patient 2110. This means for placing the foldable patient interface 2101 may be employed as an alternative to the means described above with reference to FIG. 21*d*.

Figure 22A:
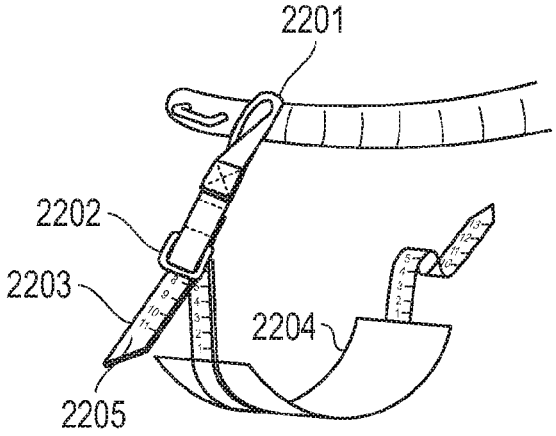
FIGS. 22*a-d* show perspective views of example embodiments for attaching patient interfaces of one embodiment of the device of the present invention.
Figure 22B:
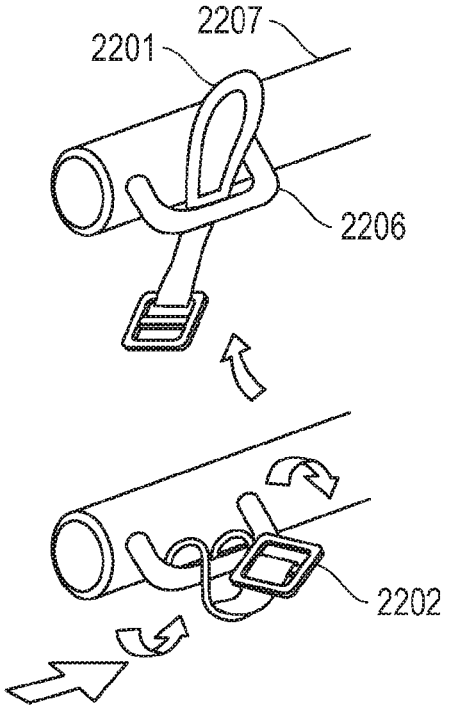
Figure 22C:
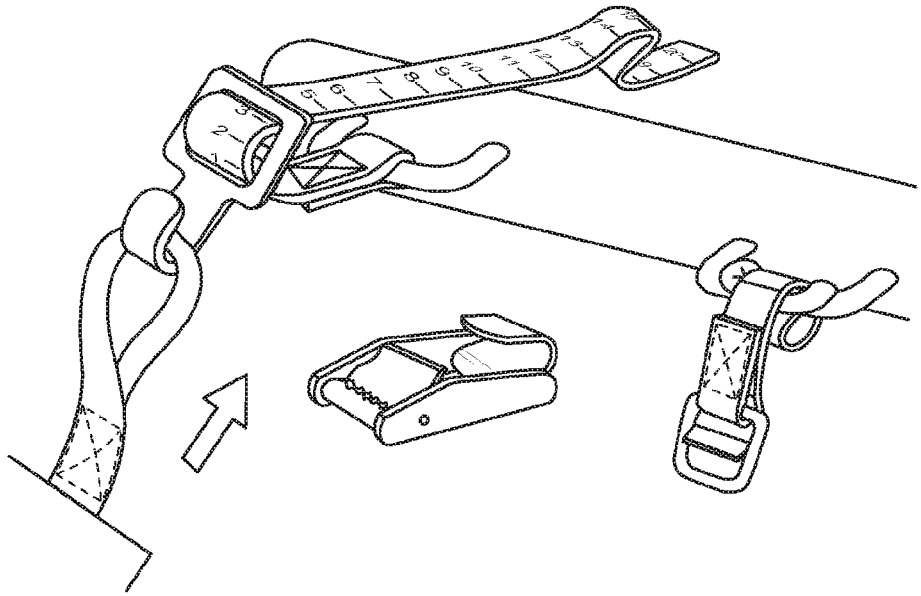
Figure 22D:
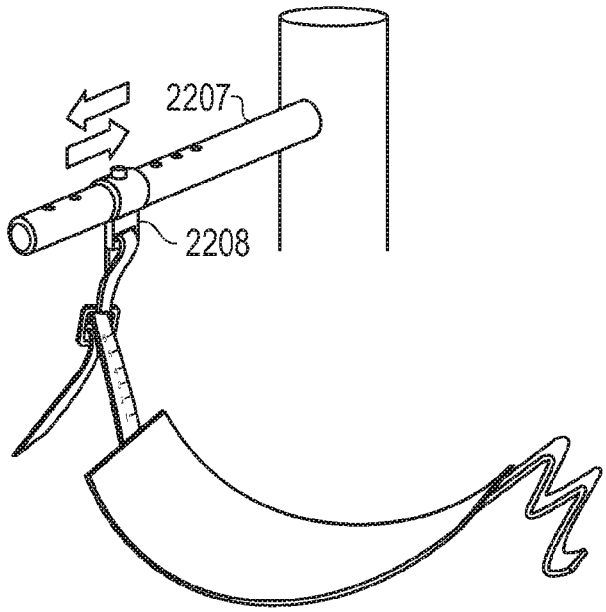

Reference is now made to FIGS. 22*a-d*, which show perspective views of example embodiments for attaching patient interfaces 2204 of one embodiment of the device of the present invention. In FIG. 22*a*, a loop 2201 is shown attached to a buckle 2202. The strap 2203 of the patient interface 2204 passes into the buckle 2202 and may be progressively tightened or loosened. The strap 2203 may also contain a graduation 2205 in numbers or symbols on at least one of its surfaces. In FIG. 22*b*, the loop 2201 is shown to connect to an attachment ring 2206 on the arm 2207 by passing the loop 2201 through the attachment ring 2206 and passing the buckle 2202 through the loop 2201. In FIG. 22*c*, alternative buckling arrangements are shown. In FIG. 22*d*, a tube connector 2208 is shown to connect around the circumference of the arm 2207. The tube connector 2208 may slide along the arm 2207 and lock into place at particular points along the arm 2207. The tube connector 2208 may be comprised of plastic, metal or webbing, for example.

Figure 23A:
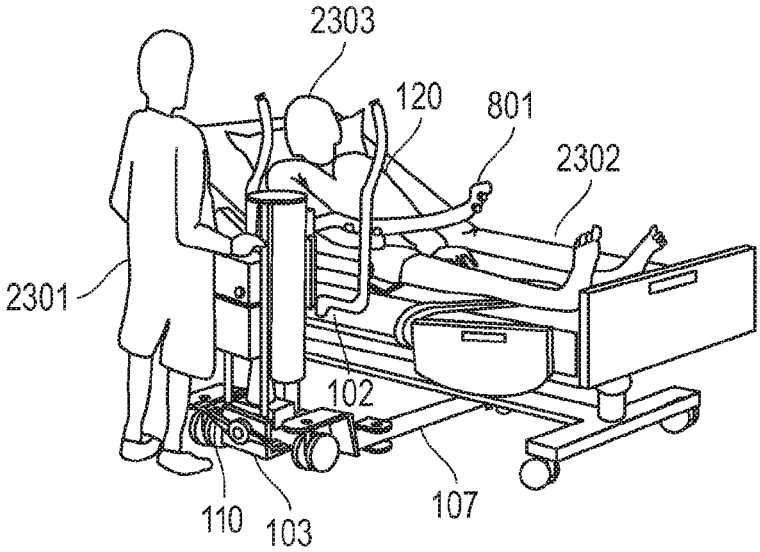
FIGS. 23*a-d* show examples of the method of operating one embodiment of the device of the present invention with a central arm attached in a horizontal orientation.

Reference is now made to FIGS. 23*a-d*, which show examples of the method of operating one embodiment of the device of the present invention with a central arm 801 attached in a horizontal orientation. In FIG. 23*a*, a caregiver 2301 is shown pushing the lift cart 103 towards one side of a bed 2302 containing a patient 2303. Once the lift cart 103 is an appropriate distance from the bed 2302, the caregiver 2301 may engage brakes on the wheels 110 of the lift cart 103 and may also spread the legs 107 of the lift cart 103 apart. In this embodiment, the frontal bars 102 of the lift cart 103 have been rotated so that the arms 120 of the frontal bars 102 extend vertically. The central arm 801 has also been attached to the lift cart 103 so that the central arm 801 extends horizontally from the lift cart 103 with the curvature of the central arm 801 concave from the perspective of the patient 2303.

Figure 23B:
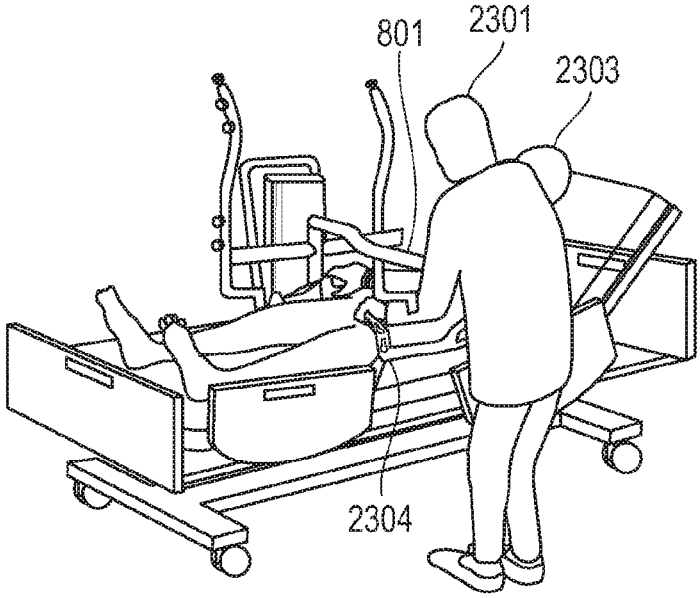

In FIG. 23*b*, a caregiver 2301 is shown positioning patient interfaces 2304 under the patient 2303. For example, a caregiver 2301 may insert patient interfaces 2304 underneath a patient 2303 without moving the patient. Alternatively, the caregiver 2301 may roll the patient 2303 onto the patient's side to in order to position the patient interfaces 2304.

Figure 23C:
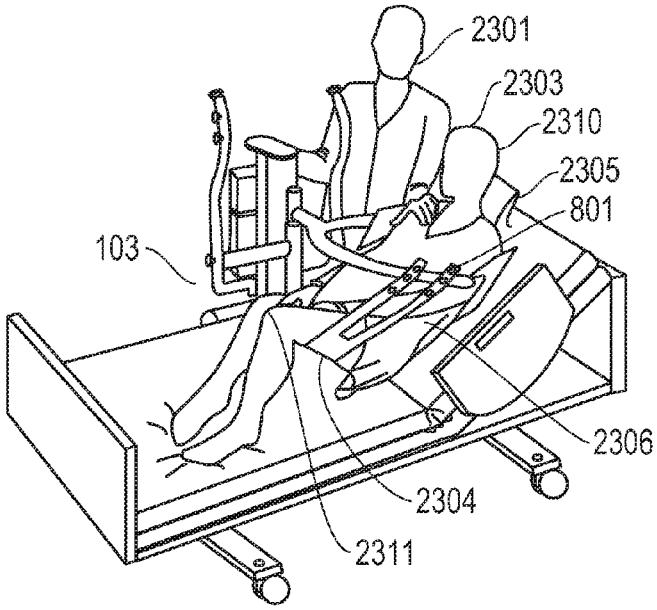

In FIG. 23*c*, a caregiver 2301 is shown connecting the patient interfaces 2304 to the central arm 801. In this embodiment, the central arm 801 extends horizontally across the front of the patient 2303. The central arm is also positioned approximately between the head 2310 and knees 2311 of the patient 2303. The height of the central arm 801 is also shown to be between the height of the shoulders 2305 and waist 2306 of the patient 2303. Once the patient interfaces 2304 have been securely fastened to the central arm 801, the lift cart 103 may raise the central arm 801 with the patient 2303 secured to the central arm 801 by the patient interfaces 2304.

Figure 23D:
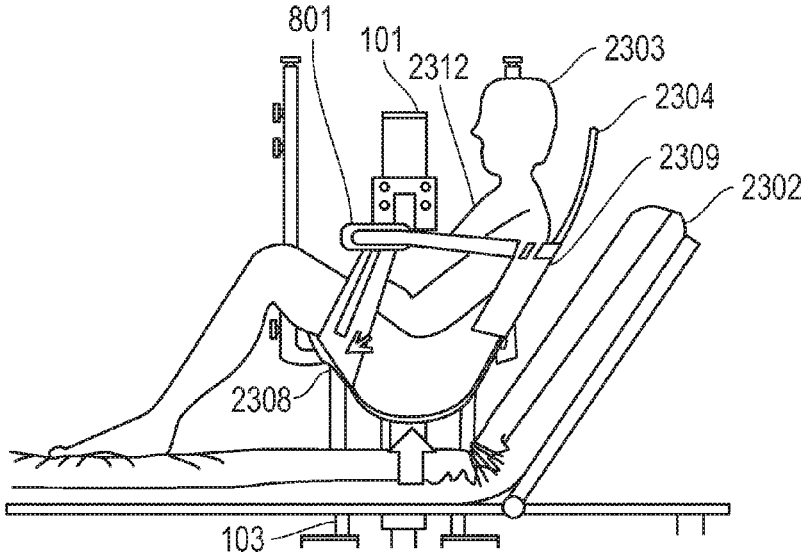

In FIG. 23*d*, the lift cart 103 is shown supporting the patient 2303 above the bed 2302. In this embodiment, the central arm 801 extends horizontally and across the front of the patient 2303. The central arm is also positioned approximately between the head 2310 and knees 2311 of the patient 2303. In this embodiment, the central arm is also shown to extend in front of the chest 2312 of the patient 2303 and over the thighs 2308 of the patient 2303. The distance between the suspended patient 2303 and the central arm 801 may prevent or reduce swaying of the suspended patient 2303, improve the patient's 2303 feelings of safety and dignity, and improve a caregiver's 2301 ability to monitor the patient 2303 and the multi-functional patient transfer device 101. With the patient 2303 suspended, the lift cart 103 may be used to transfer the patient 2303 to another location. In this embodiment, the patient interfaces 2304 include a two-piece, semi-rigid patient interface that is shown underneath the thighs 2308 and back 2309 of the patient. In one embodiment, the patient 2303 may be laterally transferred with the lift cart 103 employing a hoist 1201, such as shown in FIG. 12, as an alternative to a lateral transfer with the central arm 801. In one embodiment, the patient 2303 may be laterally transferred with the lift cart 103 employing the frontal bars 102 with individually rotating arms 120, such as shown in FIG. 5, as an alternative to the central arm 801.

Figure 24A:
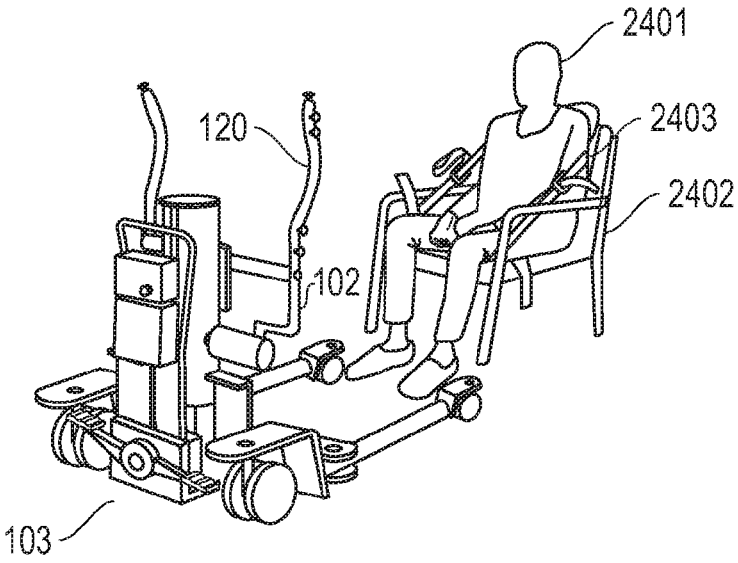
FIGS. 24*a-d* show examples of the method of operating one embodiment of the device of the present invention in connection with a seated transfer.
Figure 24B:
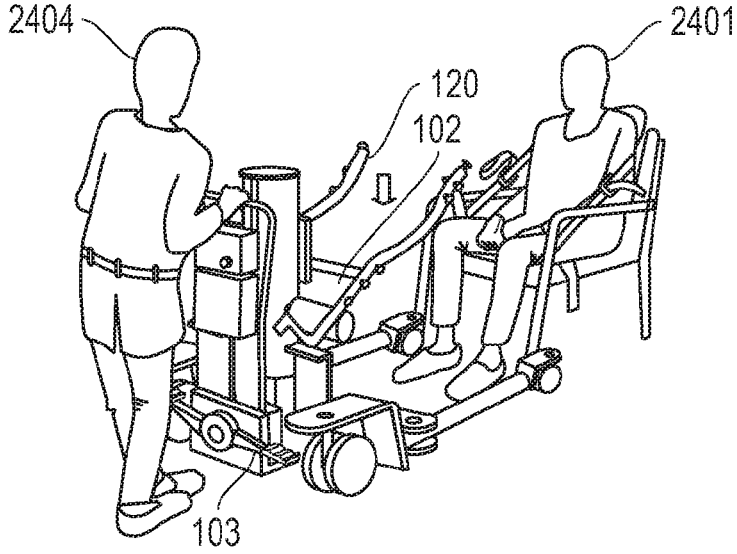

Reference is now made to FIGS. 24*a-d*, which show examples of the method of operating one embodiment of the device of the present invention in connection with a seated transfer. In FIG. 24*a*, a patient 2401 is shown seated in a chair 2402. A patient interface 2403 is also shown to be placed underneath the patient 2401 and between the patient 2401 and the chair 2402. A lift cart 103 is shown to be in front of the patient 2401. The frontal bars 102 of the lift cart 103 have been rotated so that the arms 120 of the frontal bars 102 extend vertically. In FIG. 24*b*, a caregiver 2404 is shown rotating the frontal bars 102 so that the arms 120 are rotating towards horizontal. The caregiver 2404 may also move the lift cart 103 closer to the patient 2401. The caregiver 2404 may also raise or lower the frontal bars 102 so that the height of the frontal bars 102 is, for example, between the shoulders and waist of the patient 2401.

Figure 24C:
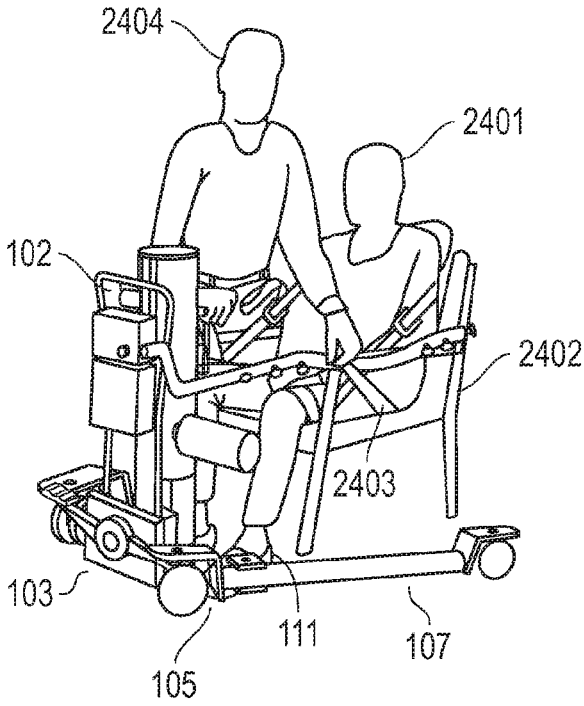
Figure 24D:
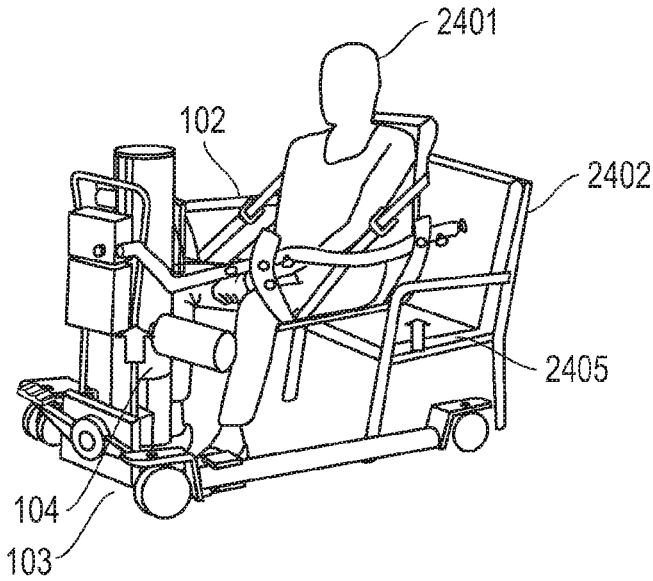

In FIG. 24*c*, the lift cart 103 is shown to be positioned closer to the patient 2401. The patient 2401 may, for example, place her feet onto footrests 111 connected to the base 105 of the lift cart 103. The caregiver 2404 is shown to be attaching the patient interface 2403 to the frontal bars 102. The caregiver 2404 has also spread the legs 107 of the lift cart 103 apart so that one leg 107 of the lift cart 103 extends along either side of the chair 2402. Once the patient interface 2403 has been securely fastened to the frontal bars 102, the lift cart 103 may be used to raise the frontal bars 102, and the patient 2401 secured to the frontal bars 102 with the patient interface 2403. In FIG. 24*d*, the lift cart 103 is shown supporting the patient 2401 above the seat 2405 of the chair 2402. The central structure 104 of the lift cart 103 is also shown to have extended upward so as to raise the frontal bars 102 and the supported patient 2401. With the patient 2401 suspended, the lift cart 103 may be used to transfer the patient 2401 to another location.

Figure 25:
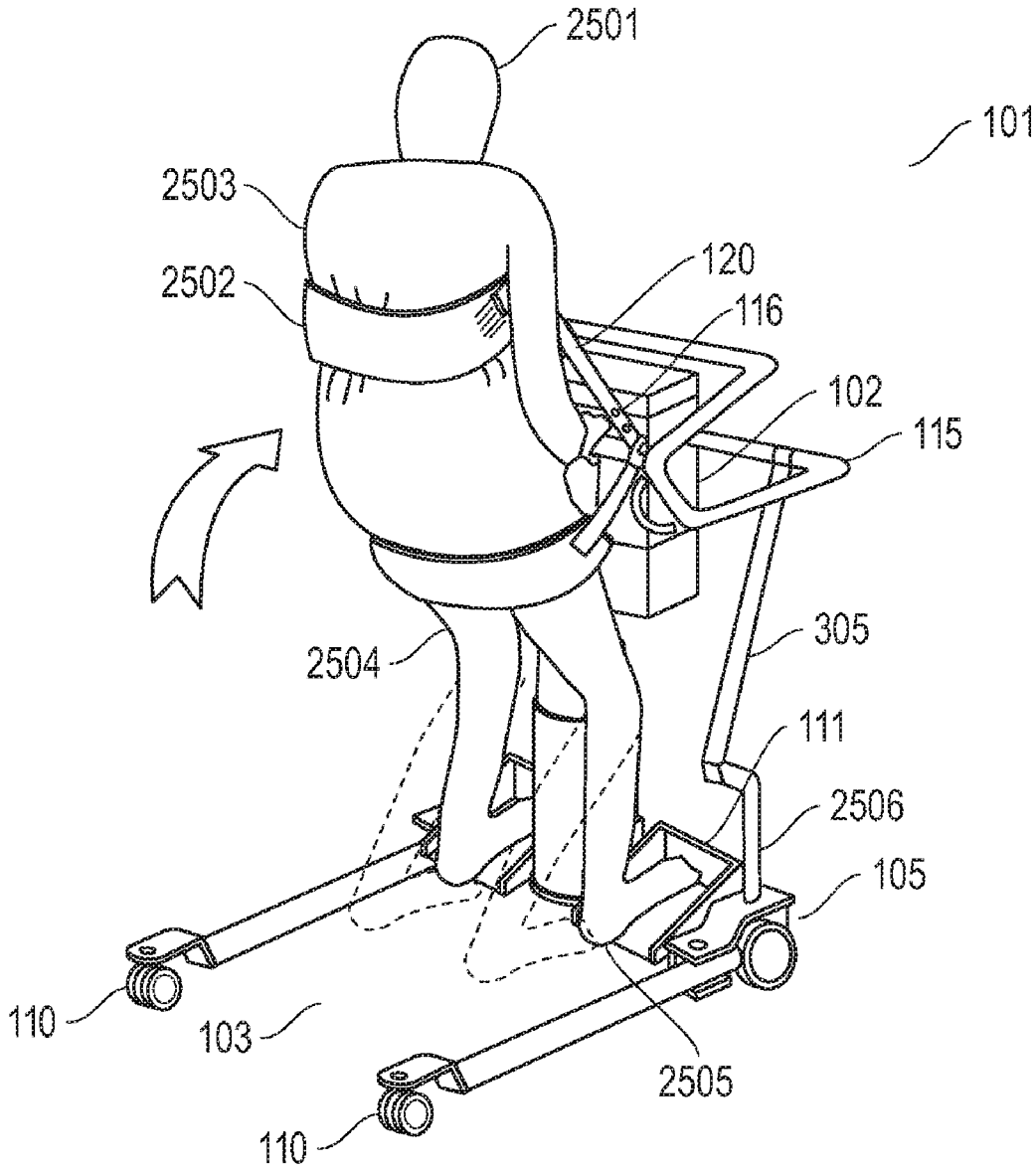
FIG. 25 shows an example of operating one embodiment of the device of the present invention in connection with a transition between sitting and standing.

Reference is now made to FIG. 25, which shows an example of operating one embodiment of the device of the present invention in connection with a transition between sitting and standing. In FIG. 25, a patient 2501 is shown transitioning from a sitting position to a standing position. In one embodiment, patient interfaces 2502 may be placed behind the back 2503 and underneath the thighs 2504 of the patient 2501 while the patient 2501 is seated. The lift cart 103 may then be moved in front of the patient 2501, the frontal bars 102 of the lift cart 103 may be rotated horizontally, and the patient interfaces 2502 may be attached to the frontal bars 102. The wheels 110 of the lift cart 103 may also be locked to prevent the lift cart 103 from rolling. The cable 305, shown in FIG. 25 as a belt, has been attached to the outer handlebar 115 of the frontal bars 102 and an extension 2506 of the base 105 of the lift cart 103. The length of the cable 305 may also be adjusted to match the rotation of the frontal bars 102 with the vertical movement of the central structure 104 and/or personal attributes of the patient 2501. Such personal attributes of the patient 2501 may include height, torso length, arm length, and/or leg length. The patient 2501 is shown in FIG. 25 to grip the attachment bar 116 of the frontal bars 102. Alternatively, the patient 2501 may choose to grip the arms 120 of the frontal bars 102. The patient 2501 may also choose to place her feet 2505 on the ground or on footrests 111 attached at the base 105 of the lift cart 103. As the central structure 104 is raised, the cable 305 assists the rotation of the frontal bars 102 from a position in which the arms 120 of the frontal bars 102 extend horizontally to a position in which the arms 120 of the frontal bars 102 extend at an angle between horizontal and vertical, such as shown in FIG. 25. This rotation of the frontal bars 102 may allow the patient interfaces 2502 to partially support the weight of the patient 2501 and move the center of gravity of the patient 2501 closer in line vertically with her feet 2505. In one embodiment, the patient 2501 may also rest her knees or shins against a knee blocker (not shown) as the rotation of the frontal bars 102 raise her upper torso towards the lift cart 103. If the feet 2505 are placed on the footrests 111, the lift cart 103 may also be used to transfer the patient 2501 in a standing or near standing position. In one embodiment, the patient 2501 may repeat transitions between a sitting and standing position with the multi-functional patient transfer device 101 as part of rehabilitation therapy.

It will be appreciated by persons skilled in the art that the present invention is not limited by what has been particularly shown and described hereinabove and other embodiments may fall within the spirit and scope of the invention, as defined by the following claims.

What is claimed is:

1. A patient transfer device comprising:

a central arm configured to connect to a lift cart and a patient interface, said central arm having a single distal end and including a curve that approximates the curvature of the chest of a patient, wherein said central arm is configured to connect to a safety mechanism, the top of said safety mechanism being hinged with a horizontal rotation axis to a central structure of said lift cart; and said lift cart configured to raise and lower said patient with said patient supported by said patient interface, with said patient interface connected to said central arm, and with said central arm extending horizontally across the front of said patient, approximately between the head and knees of said patient.

2. The device of claim 1 wherein said central arm is configured to connect to said lift cart such that said curve is concave to the right side or to the left side of said lift cart.

3. The device of claim 1 wherein said central arm is configured to connect to said lift cart in multiple orientations.

4. The device of claim 1 wherein the direction of said curve may be adjusted by rotating a distal portion of said central arm approximately 180 degrees about its longitudinal axis.

5. The device of claim 1 wherein said lift cart is configured to store said central arm vertically on said lift cart.

6. The device of claim 1 wherein said lift cart is configured to allow said central arm to pivot above horizontal if an upwardly directed force is applied to the underside of said central arm.

7. The device of claim 1 wherein a tabletop may connect to said central arm.

8. The device of claim 1 wherein a distal portion of said central arm includes a winch.

9. The device of claim 1 further comprising a detachable handle configured to securely fasten to said central arm.

10. The device of claim 1 wherein said patient interface includes a buttock/link support and two or more of a backrest sling, a thigh sling, and straps.

11. The device of claim 1 further comprising frontal bars configured to connect to said lift cart.

12. The device of claim 1 further comprising frontal bars configured to connect to said lift cart, said frontal bars having two arms that are approximately parallel, are configured to rotate, and may extend upwards from said lift cart in an approximately vertical orientation when said central arm is connected to said lift cart.

13. The device of claim 1 wherein said central arm includes a single proximal end and said single distal end comprises a single elongated arm.

14. The device of claim 1 wherein a proximal end of said central arm includes a right angle that may be inserted into a vertical receptacle of said lift cart.

15. The device of claim 1 wherein said lift cart such that said safety mechanism is configured to rotate upwards if an upward force is applied to said central arm.

16. The device of claim 1 wherein said central arm is configured to connect to said lift cart such that the direction of the curvature of said central arm is concave with respect to the front of said patient when said lift cart is positioned to either the right side or the left side of said patient.

17. The device of claim 1 wherein said central arm includes a worm winch internal to a distal portion of said central arm, said worm winch having a switch configured to control a length of webbing that may extend from said distal portion.

18. The device of claim 1 wherein said central arm includes at least one attachment ring.

19. The device of claim 1 wherein said central arm includes at least one attachment ring positioned near said single distal end of said central arm on the outer surface of said curve of said central arm.

20. The device of claim 1 wherein the proximal end of said central arm extends past one of the right side of said patient or the left side of said patient and said single distal end of said central arm extends past the other of the right side of said patient or the left side of said patient.

21. The device of claim 1 further comprising frontal bars configured to rotate such that arms of said frontal bars may extend horizontally outward from said lift cart after said central arm is removed from said central structure.

22. A patient transfer device comprising:

a central arm configured to connect to a lift cart and a patient interface, said central arm having a single distal end and including a curve that approximates the curvature of the chest of a patient;

said lift cart configured to allow said central arm to pivot above horizontal if an upwardly directed force is applied to the underside of said central arm; and said lift cart configured to raise and lower said patient with said patient supported by said patient interface, with said patient interface connected to said central arm, and with said central arm extending horizontally across the front of said patient, approximately between the head and knees of said patient.

23. The device of claim 22 wherein said central arm is configured to connect to said lift cart such that said curve is concave to the right side or to the left side of said lift cart.

24. The device of claim 22 wherein said central arm is configured to connect to said lift cart in multiple orientations.

25. The device of claim 22 wherein the direction of said curve may be adjusted by rotating a distal portion of said central arm approximately 180 degrees about its longitudinal axis.

26. The device of claim 22 wherein said lift cart is configured to store said central arm vertically on said lift cart.

27. The device of claim 22 wherein said central arm is configured to connect to a safety mechanism, the top of said safety mechanism being hinged with a horizontal rotation axis to the central structure of said lift cart.

28. The device of claim 22 wherein a tabletop may connect to said central arm.

29. The device of claim 22 wherein a distal portion of said central arm includes a winch.

30. The device of claim 22 further comprising a detachable handle configured to securely fasten to said central arm.

31. The device of claim 22 wherein said patient interface includes a buttock/link support and two or more of a backrest sling, a thigh sling, and straps.

32. The device of claim 22 further comprising frontal bars configured to connect to said lift cart.

33. The device of claim 22 further comprising frontal bars configured to connect to said lift cart, said frontal bars having two arms that are approximately parallel, are configured to rotate, and may extend upwards from said lift cart in an approximately vertical orientation when said central arm is connected to said lift cart.

34. The device of claim 22 wherein said central arm includes a single proximal end and said single distal end comprises a single elongated arm.

35. The device of claim 22 wherein the proximal end of said central arm includes a right angle that may be inserted into a vertical receptacle of said lift cart.

36. The device of claim 22 wherein said central arm is configured to connect to a safety mechanism and the top of said safety mechanism is hinged with a horizontal axis of rotation to said lift cart such that said safety mechanism is configured to rotate upwards if an upward force is applied to said central arm.

37. The device of claim 22 wherein said central arm is configured to connect to said lift cart such that the direction of the curvature of said central arm is concave with respect to the front of said patient when said lift cart is positioned to either the right side or the left side of said patient.

38. The device of claim 22 wherein said central arm includes a worm winch internal to a distal portion of said central arm, said worm winch having a switch configured to control webbing that may extend from said distal portion.

39. The device of claim 22 wherein said central arm includes at least one attachment ring.

40. The device of claim 22 wherein said central arm includes at least one attachment ring positioned near said single distal end of said central arm on the outer surface of said curve of said central arm.

41. The device of claim 22 wherein a proximal end of said central arm extends past one of the right side of said patient or the left side of said patient and said single distal end of said central arm extends past the other of the right side of said patient or the left side of said patient.

42. The device of claim 22 further comprising frontal bars configured to rotate such that the arms of said frontal bars extend horizontally outward from said lift cart after said central arm is removed from said central structure.

43. A patient transfer device comprising:

a central arm configured to connect to a patient interface and a safety mechanism wherein the top of said safety mechanism is hinged with a horizontal axis of rotation to a lift cart such that said safety mechanism is configured to rotate upwards if an upward force is applied to said central arm;

said central arm having a single distal end and including a curve that approximates the curvature of the chest of a patient; and said lift cart configured to raise and lower said patient with said patient supported by said patient interface, with said patient interface connected to said central arm, and with said central arm extending horizontally across the front of said patient, approximately between the head and knees of said patient.

44. The device of claim 43 wherein said central arm is configured to connect to said safety mechanism such that said curve is concave to the right side or to the left side of said lift cart.

45. The device of claim 43 wherein said central arm is configured to connect to said safety mechanism in multiple orientations.

46. The device of claim 43 wherein the direction of said curve may be adjusted by rotating a distal portion of said central arm approximately 180 degrees about its longitudinal axis.

47. The device of claim 43 wherein said lift cart is configured to store said central arm vertically on said lift cart.

48. The device of claim 43 wherein a tabletop may connect to said central arm.

49. The device of claim 43 wherein a distal portion of said central arm includes a winch.

50. The device of claim 43 further comprising a detachable handle configured to securely fasten to said central arm.

51. The device of claim 43 wherein said patient interface includes a buttock/link support and two or more of a backrest sling, a thigh sling, and straps.

52. The device of claim 43 further comprising frontal bars configured to connect to said lift cart.

53. The device of claim 43 further comprising frontal bars configured to connect to said lift cart, said frontal bars having two arms that are approximately parallel, are configured to rotate, and may extend upwards from said lift cart in an approximately vertical orientation when said central arm is connected to said lift cart.

54. The device of claim 43 wherein said central arm includes a single proximal end and said single distal end comprises a single elongated arm.

55. The device of claim 43 wherein a proximal end of said central arm includes a right angle that may be inserted into a vertical receptacle of said lift cart.

56. The device of claim 43 wherein said central arm is configured to connect to said lift cart such that the direction of the curvature of said central arm is concave with respect to the front of said patient when said lift cart is positioned to either the right side or the left side of said patient.

57. The device of claim 43 wherein said central arm includes a worm winch internal to a distal portion of said central arm, said worm winch having a switch configured to control webbing that may extend from said distal portion.

58. The device of claim 43 wherein said central arm includes at least one attachment ring.

59. The device of claim 43 wherein said central arm includes at least one attachment ring positioned near said single distal end of said central arm on an outer surface of said curve of said central arm.

60. The device of claim 43 wherein a proximal end of said central arm extends past one of the right side of said patient or the left side of said patient and said single distal end of said central arm extends past the other of the right side of said patient or the left side of said patient.

61. The device of claim 43 further comprising frontal bars configured to rotate such that arms of said frontal bars extend horizontally outward from said lift cart after said central arm is removed from said central structure.

* * * * *

UNITED STATES PATENT AND TRADEMARK OFFICE

CERTIFICATE OF CORRECTION

PATENT NO. : 8,336,133 B2
APPLICATION NO. : 12/418404
DATED : December 25, 2012
INVENTOR(S) : Frederic Palay et al.

It is certified that error appears in the above-identified patent and that said Letters Patent is hereby corrected as shown below:

In claim 15, column 18, line 13, delete "said lift cart such that".

Signed and Sealed this
Twelfth Day of February, 2013

Teresa Stanek Rea
*Acting Director of the United States Patent and Trademark Office*